US010971065B2

(12) United States Patent
Hong et al.

(10) Patent No.: US 10,971,065 B2
(45) Date of Patent: Apr. 6, 2021

(54) DISPLAY DEVICE, AND METHOD OF DETERMINING A POWER SUPPLY VOLTAGE

(71) Applicant: Samsung Display Co., Ltd., Yongin-si (KR)

(72) Inventors: Seokha Hong, Seoul (KR); Sang Myeon Han, Hwaseong-si (KR); Jae Hoon Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/930,965

(22) Filed: May 13, 2020

(65) Prior Publication Data

US 2021/0065623 A1 Mar. 4, 2021

(30) Foreign Application Priority Data

Aug. 29, 2019 (KR) ..... 10-2019-0106260

(51) Int. Cl.

| | |
|---|---|
| ***G09G 3/3258*** | (2016.01) |
| ***G09G 3/20*** | (2006.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/2003* (2013.01); *G09G 3/3266* (2013.01); *G09G 3/3275* (2013.01); *G09G 2300/0452* (2013.01); *G09G 2320/0666* (2013.01); *G09G 2330/021* (2013.01)

(58) Field of Classification Search

CPC ..... G09G 3/3406; G09G 2320/0646; G09G 2340/06; G09G 3/2003; G09G 2310/0235; G09G 2320/0633; G09G 2360/16; G09G 3/346; G09G 3/3611

See application file for complete search history.

(56) References Cited

U.S. PATENT DOCUMENTS

2010/0207956 A1* 8/2010 Keh ..... G09G 3/3406 345/589
2011/0181627 A1* 7/2011 You ..... G09G 3/3406 345/690

FOREIGN PATENT DOCUMENTS

KR 10-2010-0095093 A 8/2010
KR 10-1958449 B1 3/2019
KR 10-2019-0039624 A 4/2019

* cited by examiner

*Primary Examiner* — Nelson M Rosario
(74) *Attorney, Agent, or Firm* — Lewis Roca Rothgerber Christie LLP

(57) ABSTRACT

A display device includes a display panel including first, second, and third color sub-pixels, a data driver, a scan driver, a power supply to provide a power supply voltage to the display panel, and a controller. The controller includes a pure color index calculator to calculate first through third pure color indexes of first through third sub-pixel data, a pure color index histogram generator to generate first through third high pure color index histograms, and first through third low pure color index histograms, a histogram analyzer to determine first through third effective maximum gray levels for the first through third color sub-pixels according to the first through third high pure color index histograms and the first through third low pure color index histograms, and a power supply voltage controller to determine a voltage level of the power supply voltage according to the first through third effective maximum gray levels.

20 Claims, 16 Drawing Sheets

210

PCI_RDAT = RDAT - MAX(GDAT, BDAT)

220

PCI_GDAT = GDAT - MAX(RDAT, BDAT)

230

PCI_BDAT = BDAT - MAX(RDAT, GDAT)

FIG. 6

260

| GRAY LEVEL | ELVDD_VL |
|---|---|
| 0G | EVDVL0 |
| 1G | EVDVL1 |
| ⋮ | ⋮ |
| 254G | EVDVL254 |
| 255G | EVDVL255 |

DISPLAY DEVICE, AND METHOD OF DETERMINING A POWER SUPPLY VOLTAGE

CROSS-REFERENCE TO RELATED APPLICATION

This application claims priority to and the benefit of Korean Patent Application No. 10-2019-0106260, filed on Aug. 29, 2019 in the Korean Intellectual Property Office (KIPO), the entire content of which is incorporated herein by reference.

BACKGROUND

1. Field

Aspects of example embodiments of the present disclosure relate to a display device, and more particularly, to a display device that adjusts a power supply voltage provided to a display panel, and a method of determining the power supply voltage.

2. Description of the Related Art

In a display device, such as an organic light emitting diode (OLED) display device, a power supply voltage (e.g., ELVDD) provided to a display panel may be determined or set to be sufficiently high in consideration of a drain-source voltage of a driving transistor of each sub-pixel, a voltage applied to an OLED, and a voltage drop (e.g., an IR drop) margin of the power supply voltage. However, if the power supply voltage is set to be excessively high, power consumption of the display device may be excessively increased.

Recently, to reduce the power consumption of the display device, a technique has been developed in which a maximum gray level of input image data is detected, and the power supply voltage is decreased according to the maximum gray level. However, this technique may excessively decrease the power supply voltage, and thus, a distortion (e.g., a chrominance distortion) of an image displayed by the display device may occur.

The above information disclosed in this Background section is for enhancement of understanding of the background of the present disclosure, and therefore, it may contain information that does not constitute prior art.

SUMMARY

One or more example embodiments of the present disclosure are directed to a display device capable of reducing power consumption without a chrominance distortion.

One or more example embodiments of the present disclosure are directed to a method of determining a power supply voltage capable of reducing power consumption without a chrominance distortion.

According to one or more example embodiments of the present disclosure, a display device includes: a display panel including first color sub-pixels, second color sub-pixels, and third color sub-pixels; a data driver configured to provide data signals to the display panel; a scan driver configured to provide scan signals to the display panel; a power supply configured to provide a power supply voltage to the display panel; and a controller configured to control the data driver, the scan driver, and the power supply. The controller includes: a pure color index calculator configured to calculate first, second, and third pure color indexes of first, second, and third sub-pixel data for the first, second, and third color sub-pixels; a pure color index histogram generator configured to: divide the first, second, and third sub-pixel data into first, second, and third high pure color sub-pixel data, and first, second, and third low pure color sub-pixel data according to the first, second, and third pure color indexes; generate first, second, and third high pure color index histograms according to gray levels of the first, second, and third high pure color sub-pixel data; and generate first, second, and third low pure color index histograms according to gray levels of the first, second, and third low pure color sub-pixel data; a histogram analyzer configured to determine first, second, and third effective maximum gray levels for the first, second, and third color sub-pixels according to the first, second, and third high pure color index histograms and the first, second, and third low pure color index histograms; and a power supply voltage controller configured to: determine a voltage level of the power supply voltage according to the first, second, and third effective maximum gray levels; and provide a power supply voltage control signal to the power supply indicating the determined voltage level of the power supply voltage. The power supply is configured to generate the power supply voltage having the determined voltage level.

In an example embodiment, the pure color index calculator may be configured to: calculate the first pure color index of the first sub-pixel data for each pixel by subtracting a greater one from among a gray level of the second sub-pixel data for the pixel and a gray level of the third sub-pixel data for the pixel from a gray level of the first sub-pixel data for the pixel; calculate the second pure color index of the second sub-pixel data for each pixel by subtracting a greater one from among the gray level of the first sub-pixel data for the pixel and the gray level of the third sub-pixel data for the pixel from the gray level of the second sub-pixel data for the pixel; and calculate the third pure color index of the third sub-pixel data for each pixel by subtracting a greater one from among the gray level of the first sub-pixel data for the pixel and the gray level of the second sub-pixel data for the pixel from the gray level of the third sub-pixel data for the pixel.

In an example embodiment, the pure color index histogram generator may be configured to: divide the first sub-pixel data into the first high pure color sub-pixel data and the first low pure color sub-pixel data by comparing the first pure color indexes of the first sub-pixel data with a pure color index threshold value; divide the second sub-pixel data into the second high pure color sub-pixel data and the second low pure color sub-pixel data by comparing the second pure color indexes of the second sub-pixel data with the pure color index threshold value; divide the third sub-pixel data into the third high pure color sub-pixel data and the third low pure color sub-pixel data by comparing the third pure color indexes of the third sub-pixel data with the pure color index threshold value; generate the first high pure color index histogram by grouping the first high pure color sub-pixel data into a plurality of gray groups according to the gray levels of the first high pure color sub-pixel data, the first high pure color index histogram indicating numbers of the first high pure color sub-pixel data belonging to the plurality of gray groups; generate the second high pure color index histogram by grouping the second high pure color sub-pixel data into the plurality of gray groups according to the gray levels of the second high pure color sub-pixel data, the second high pure color index histogram indicating numbers of the second high pure color sub-pixel data belonging to the plurality of gray groups; generate the third high pure color index histogram by grouping the third high pure color sub-pixel data into the plurality of gray groups according to the gray levels of the third high pure color sub-pixel data, the third high pure color index histogram indicating numbers of the third high pure color sub-pixel data belonging to the plurality of gray groups; generate the first low pure color index histogram by grouping the first low pure color sub-pixel data into the plurality of gray groups according to the gray levels of the first low pure color sub-pixel data, the first low pure color index histogram indicating numbers of the first low pure color sub-pixel data belonging to the plurality of gray groups; generate the second low pure color index histogram by grouping the second low pure color sub-pixel data into the plurality of gray groups according to the gray levels of the second low pure color sub-pixel data, the second low pure color index histogram indicating numbers of the second low pure color sub-pixel data belonging to the plurality of gray groups; and generate the third low pure color index histogram by grouping the third low pure color sub-pixel data into the plurality of gray groups according to the gray levels of the third low pure color sub-pixel data, the third low pure color index histogram indicating numbers of the third low pure color sub-pixel data belonging to the plurality of gray groups.

In an example embodiment, the pure color index threshold value may be set according to a pure color index threshold parameter, and boundary values between the plurality of gray groups may be determined according to gray group boundary parameters.

In an example embodiment, the histogram analyzer may be configured to: determine a first high pure color effective maximum gray level by accumulating the numbers of the first high pure color sub-pixel data belonging to the plurality of gray groups of the first high pure color index histogram in a direction from a maximum gray group of the plurality of gray groups to a minimum gray group of the plurality of gray groups, and comparing a ratio of the accumulated numbers of the first high pure color sub-pixel data to a total number of the first high pure color sub-pixel data with a high pure color reference pixel ratio; determine a second high pure color effective maximum gray level by accumulating the numbers of the second high pure color sub-pixel data belonging to the plurality of gray groups of the second high pure color index histogram in the direction from the maximum gray group to the minimum gray group, and comparing a ratio of the accumulated numbers of the second high pure color sub-pixel data to a total number of the second high pure color sub-pixel data with the high pure color reference pixel ratio; determine a third high pure color effective maximum gray level by accumulating the numbers of the third high pure color sub-pixel data belonging to the plurality of gray groups of the third high pure color index histogram in the direction from the maximum gray group to the minimum gray group, and comparing a ratio of the accumulated numbers of the third high pure color sub-pixel data to a total number of the third high pure color sub-pixel data with the high pure color reference pixel ratio; determine a first low pure color effective maximum gray level by accumulating the numbers of the first low pure color sub-pixel data belonging to the plurality of gray groups of the first low pure color index histogram in the direction from the maximum gray group to the minimum gray group, and comparing a ratio of the accumulated numbers of the first low pure color sub-pixel data to a total number of the first low pure color sub-pixel data with a low pure color reference pixel ratio; determine a second low pure color effective maximum gray level by accumulating the numbers of the second low pure color sub-pixel data belonging to the plurality of gray groups of the second low pure color index histogram in the direction from the maximum gray group to the minimum gray group, and comparing a ratio of the accumulated numbers of the second low pure color sub-pixel data to a total number of the second low pure color sub-pixel data with the low pure color reference pixel ratio; determine a third low pure color effective maximum gray level by accumulating the numbers of the third low pure color sub-pixel data belonging to the plurality of gray groups of the third low pure color index histogram in the direction from the maximum gray group to the minimum gray group, and comparing a ratio of the accumulated numbers of the third low pure color sub-pixel data to a total number of the third low pure color sub-pixel data with the low pure color reference pixel ratio; determine a greater one from among the first high pure color effective maximum gray level and the first low pure color effective maximum gray level as the first effective maximum gray level; determine a greater one from among the second high pure color effective maximum gray level and the second low pure color effective maximum gray level as the second effective maximum gray level; and determine a greater one from among the third high pure color effective maximum gray level and the third low pure color effective maximum gray level as the third effective maximum gray level.

In an example embodiment, the high pure color reference pixel ratio may be greater than the low pure color reference pixel ratio.

In an example embodiment, the power supply voltage controller may include: a lookup table configured to store the voltage level of the power supply voltage corresponding to each of gray levels, and the power supply voltage controller may be configured to: determine a maximum one from among the first, second, and third effective maximum gray levels as a maximum gray level; determine the voltage level of the power supply voltage corresponding to the maximum gray level by using the lookup table; and provide the power supply voltage control signal to the power supply indicating the determined voltage level of the power supply voltage.

In an example embodiment, the display panel may be divided into a plurality of pixel blocks, and the pure color index histogram generator may be configured to generate the first, second, and third high pure color index histograms, and the first, second, and third low pure color index histograms with respect to each of the plurality of pixel blocks.

In an example embodiment, the histogram analyzer may be configured to: determine a plurality of first block effective maximum gray levels, a plurality of second block effective maximum gray levels, and a plurality of third block effective maximum gray levels with respect to the plurality of pixel blocks; determine a maximum one from among the plurality of first block effective maximum gray levels as the first effective maximum gray level; determine a maximum one from among the plurality of second block effective maximum gray levels as the second effective maximum gray level; and determine a maximum one from among the plurality of third block effective maximum gray levels as the third effective maximum gray level.

In an example embodiment, the power supply voltage controller may include: a first lookup table configured to store a first voltage level of the power supply voltage corresponding to each of gray levels for the first color sub-pixels; a second lookup table configured to store a second voltage level of the power supply voltage corresponding to each of gray level for the second color sub-pixels; and a third lookup table configured to store a third voltage level of the power supply voltage corresponding to each of gray levels for the third color sub-pixels. The power supply voltage controller may be configured to: determine the first voltage level of the power supply voltage corresponding to the first effective maximum gray level by using the first lookup table; determine the second voltage level of the power supply voltage corresponding to the second effective maximum gray level by using the second lookup table; determine the third voltage level of the power supply voltage corresponding to the third effective maximum gray level by using the third lookup table; and provide the power supply voltage control signal to the power supply indicating a maximum one from among the first, second, and third voltage levels of the power supply voltage.

In an example embodiment, the controller may further include: a maximum gray detector configured to: determine a maximum one from among gray levels of the first sub-pixel data as a first maximum gray level; determine a maximum one from among gray levels of the second sub-pixel data as a second maximum gray level; and determine a maximum one from among gray levels of the third sub-pixel data as a third maximum gray level. The power supply voltage controller may be configured to: receive a mode select signal indicating a first mode or a second mode; determine the voltage level of the power supply voltage according to the first, second, and third effective maximum gray levels from the histogram analyzer when the mode select signal indicates the first mode; and determine the voltage level of the power supply voltage according to the first, second, and third maximum gray levels from the maximum gray detector when the mode select signal indicates the second mode.

In an example embodiment, the power supply voltage controller may include: a lookup table configured to store a first voltage level of the power supply voltage corresponding to each of gray levels; a power supply voltage determination circuit configured to determine a maximum one from among the first, second, and third effective maximum gray levels as a maximum gray level, and to determine the first voltage level of the power supply voltage corresponding to the maximum gray level by using the lookup table; an adder configured to receive a power supply voltage offset signal indicating an offset level for the power supply voltage, and to add the offset level to the first voltage level of the power supply voltage; and a control signal output circuit configured to provide the power supply voltage control signal to the power supply indicating the voltage level of the power supply voltage output from the adder.

In an example embodiment, the power supply may be configured to provide a first power supply voltage for the first color sub-pixels, a second power supply voltage for the second color sub-pixels, and a third power supply voltage for the third color sub-pixels to the display panel as the power supply voltage, and the power supply voltage controller may be configured to: determine a voltage level of the first power supply voltage according to the first effective maximum gray level; determine a voltage level of the second power supply voltage according to the second effective maximum gray level; determine a voltage level of the third power supply voltage according to the third effective maximum gray level; and provide a first power supply voltage control signal indicating the determined voltage level of the first power supply voltage, a second power supply voltage control signal indicating the determined voltage level of the second power supply voltage, and a third power supply voltage control signal indicating the determined voltage level of the third power supply voltage to the power supply as the power supply voltage control signal.

In an example embodiment, the power supply voltage controller may include: a first lookup table configured to store the voltage level of the first power supply voltage corresponding to each of gray levels for the first color sub-pixels; a second lookup table configured to store the voltage level of the second power supply voltage corresponding to each of gray levels for the second color sub-pixels; and a third lookup table configured to store the voltage level of the third power supply voltage corresponding to each of gray levels for the third color sub-pixels. The power supply voltage controller may be configured to: determine the voltage level of the first power supply voltage corresponding to the first effective maximum gray level by using the first lookup table; determine the voltage level of the second power supply voltage corresponding to the second effective maximum gray level by using the second lookup table; and determine the voltage level of the third power supply voltage corresponding to the third effective maximum gray level by using the third lookup table.

In an example embodiment, the first color sub-pixels may be red sub-pixels, the second color sub-pixels may be green sub-pixels, and the third color sub-pixels may be blue sub-pixels.

According to one or more example embodiments of the present disclosure, a method of determining a power supply voltage provided to a display panel including first color sub-pixels, second color sub-pixels, and third color sub-pixels is provided. The method includes: calculating first, second, and third pure color indexes of first, second, and third sub-pixel data for the first, second, and third color sub-pixels; dividing the first, second, and third sub-pixel data into first, second, and third high pure color sub-pixel data and first, second, and third low pure color sub-pixel data according to the first, second, and third pure color indexes; generating first, second, and third high pure color index histograms according to gray levels of the first, second, and third high pure color sub-pixel data; generating first, second, and third low pure color index histograms according to gray levels of the first, second, and third low pure color sub-pixel data; determining first, second, and third effective maximum gray levels for the first, second, and third color sub-pixels according to the first, second, and third high pure color index histograms and the first, second, and third low pure color index histograms; and determining a voltage level of the power supply voltage according to the first, second, and third effective maximum gray levels.

In an example embodiment, the calculating of the first, second, and third pure color indexes may include: calculating the first pure color index of the first sub-pixel data for each pixel of the display panel by subtracting a greater one from among a gray level of the second sub-pixel data for the pixel and a gray level of the third sub-pixel data for the pixel from a gray level of the first sub-pixel data for the pixel; calculating the second pure color index of the second sub-pixel data for each pixel by subtracting a greater one from among the gray level of the first sub-pixel data for the pixel and the gray level of the third sub-pixel data for the pixel from the gray level of the second sub-pixel data for the pixel; and calculating the third pure color index of the third sub-pixel data for each pixel by subtracting a greater one from among the gray level of the first sub-pixel data for the pixel and the gray level of the second sub-pixel data for the pixel from the gray level of the third sub-pixel data for the pixel.

In an example embodiment, the generating of the first, second, and third high pure color index histograms may include: generating the first high pure color index histogram by grouping the first high pure color sub-pixel data into a plurality of gray groups according to the gray levels of the first high pure color sub-pixel data, the first high pure color index histogram indicating numbers of the first high pure color sub-pixel data belonging to the plurality of gray groups; generating the second high pure color index histogram by grouping the second high pure color sub-pixel data into the plurality of gray groups according to the gray levels of the second high pure color sub-pixel data, the second high pure color index histogram indicating numbers of the second high pure color sub-pixel data belonging to the plurality of gray groups; and generating the third high pure color index histogram by grouping the third high pure color sub-pixel data into the plurality of gray groups according to the gray levels of the third high pure color sub-pixel data, the third high pure color index histogram indicating numbers of the third high pure color sub-pixel data belonging to the plurality of gray groups. The generating of the first, second, and third low pure color index histograms may include: generating the first low pure color index histogram by grouping the first low pure color sub-pixel data into the plurality of gray groups according to the gray levels of the first low pure color sub-pixel data, the first low pure color index histogram indicating numbers of the first low pure color sub-pixel data belonging to the plurality of gray groups; generating the second low pure color index histogram by grouping the second low pure color sub-pixel data into the plurality of gray groups according to the gray levels of the second low pure color sub-pixel data, the second low pure color index histogram indicating numbers of the second low pure color sub-pixel data belonging to the plurality of gray groups; and generating the third low pure color index histogram by grouping the third low pure color sub-pixel data into the plurality of gray groups according to the gray levels of the third low pure color sub-pixel data, the third low pure color index histogram indicating numbers of the third low pure color sub-pixel data belonging to the plurality of gray groups.

In an example embodiment, the determining of the first, second, and third effective maximum gray levels may include: determining a first high pure color effective maximum gray level by accumulating the numbers of the first high pure color sub-pixel data belonging to the plurality of gray groups of the first high pure color index histogram in a direction from a maximum gray group of the plurality of gray groups to a minimum gray group of the plurality of gray groups, and comparing a ratio of the accumulated numbers of the first high pure color sub-pixel data to a total number of the first high pure color sub-pixel data with a high pure color reference pixel ratio; determining a second high pure color effective maximum gray level by accumulating the numbers of the second high pure color sub-pixel data belonging to the plurality of gray groups of the second high pure color index histogram in the direction from the maximum gray group to the minimum gray group, and comparing a ratio of the accumulated numbers of the second high pure color sub-pixel data to a total number of the second high pure color sub-pixel data with the high pure color reference pixel ratio; determining a third high pure color effective maximum gray level by accumulating the numbers of the third high pure color sub-pixel data belonging to the plurality of gray groups of the third high pure color index histogram in the direction from the maximum gray group to the minimum gray group, and comparing a ratio of the accumulated numbers of the third high pure color sub-pixel data to a total number of the third high pure color sub-pixel data with the high pure color reference pixel ratio; determining a first low pure color effective maximum gray level by accumulating the numbers of the first low pure color sub-pixel data belonging to the plurality of gray groups of the first low pure color index histogram in the direction from the maximum gray group to the minimum gray group, and comparing a ratio of the accumulated numbers of the first low pure color sub-pixel data to a total number of the first low pure color sub-pixel data with a low pure color reference pixel ratio; determining a second low pure color effective maximum gray level by accumulating the numbers of the second low pure color sub-pixel data belonging to the plurality of gray groups of the second low pure color index histogram in the direction from the maximum gray group to the minimum gray group, and comparing a ratio of the accumulated numbers of the second low pure color sub-pixel data to a total number of the second low pure color sub-pixel data with the low pure color reference pixel ratio; determining a third low pure color effective maximum gray level by accumulating the numbers of the third low pure color sub-pixel data belonging to the plurality of gray groups of the third low pure color index histogram in the direction from the maximum gray group to the minimum gray group, and comparing a ratio of the accumulated numbers of the third low pure color sub-pixel data to a total number of the third low pure color sub-pixel data with the low pure color reference pixel ratio; determining a greater one from among the first high pure color effective maximum gray level and the first low pure color effective maximum gray level as the first effective maximum gray level; determining a greater one from among the second high pure color effective maximum gray level and the second low pure color effective maximum gray level as the second effective maximum gray level; and determining a greater one from among the third high pure color effective maximum gray level and the third low pure color effective maximum gray level as the third effective maximum gray level.

In an example embodiment, the high pure color reference pixel ratio may be greater than the low pure color reference pixel ratio.

According to one or more example embodiments of the present disclosure, a display device and a method of determining a power supply voltage may be provided, in which pure color indexes of sub-pixel data may be calculated, the sub-pixel data may be divided into high pure color sub-pixel data and low pure color sub-pixel data according to the pure color indexes, high pure color index histograms may be generated according to (e.g., based on) gray levels of the high pure color sub-pixel data, low pure color index histograms may be generated according to (e.g., based on) gray levels of the low pure color sub-pixel data, and the power supply voltage may be adjusted according to (e.g., based on) the high pure color index histograms and the low pure color index histograms. Accordingly, because the power supply voltage may be adjusted in consideration of the pure color indexes, power consumption of the display device may be reduced while preventing or reducing a chrominance distortion.

BRIEF DESCRIPTION OF THE DRAWINGS

The above and other aspects and features of the present disclosure will become more apparent to those skilled in the art from the following detailed description of the example embodiments with reference to the accompanying drawings.

FIG. 6 is a diagram illustrating an example of a lookup table included in a power supply voltage control block illustrated in FIG. 1.

DETAILED DESCRIPTION

Figure 1:
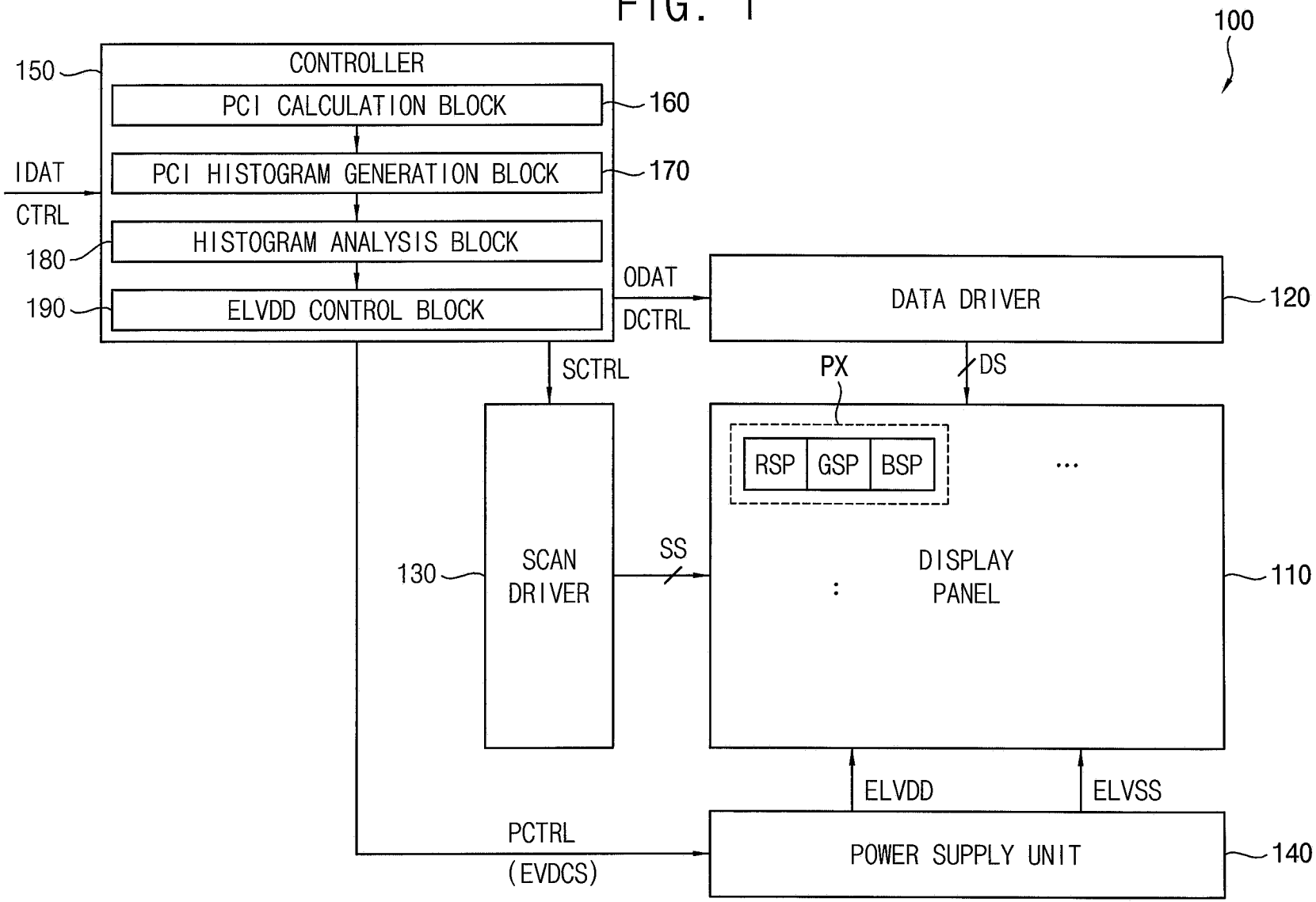
FIG. 1 is a block diagram illustrating a display device according to example embodiments.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figures 2, 3:
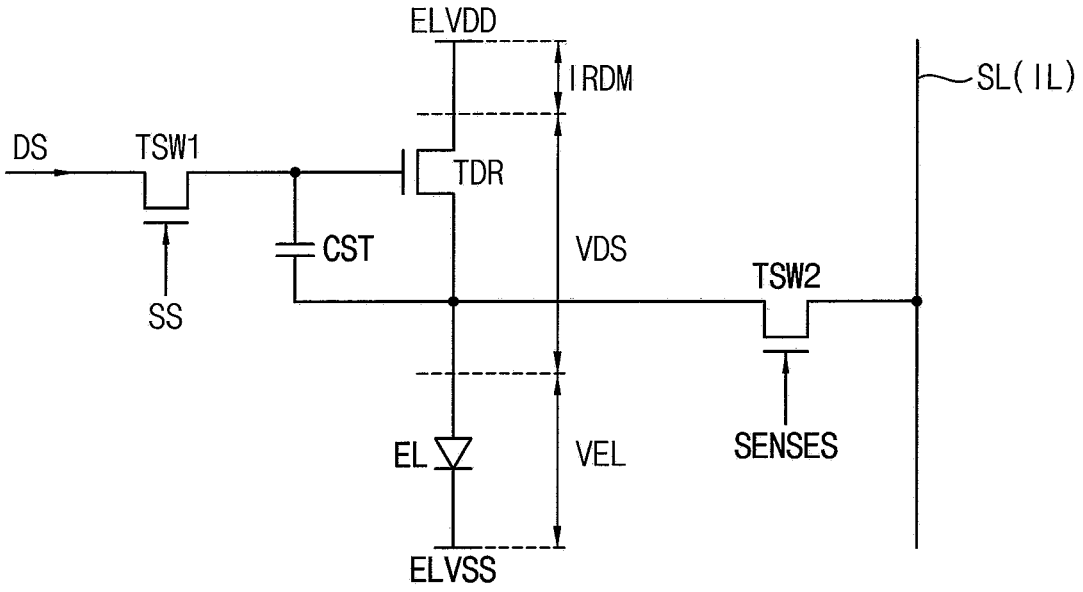
FIG. 2 is a circuit diagram illustrating an example of a sub-pixel included in a display device according to example embodiments.
FIG. 3 is a diagram illustrating an example of equations used by a pure color index calculation block illustrated in FIG. 1.
Figure 4:
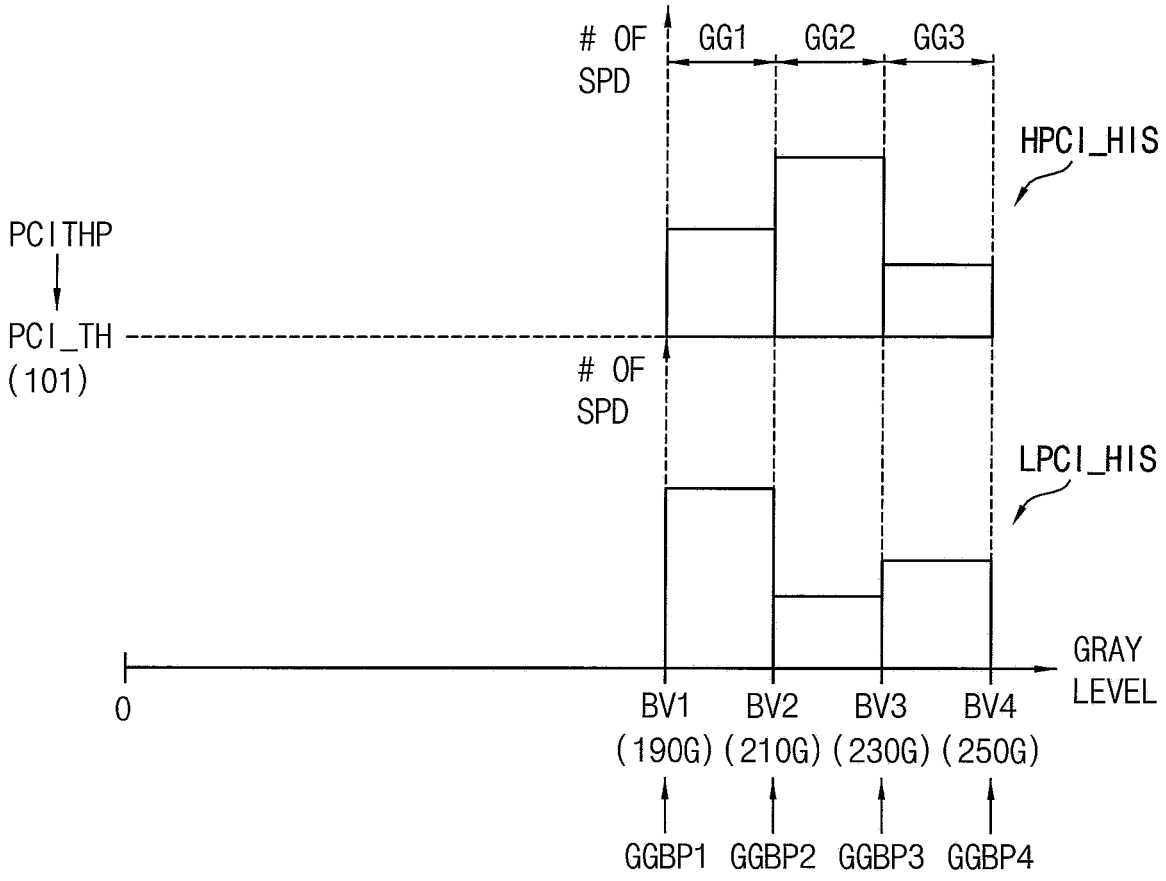
FIG. 4 is a diagram illustrating an example of a high pure color index histogram and a low pure color index histogram generated by a pure color index histogram generation block illustrated in FIG. 1.
Figure 5:
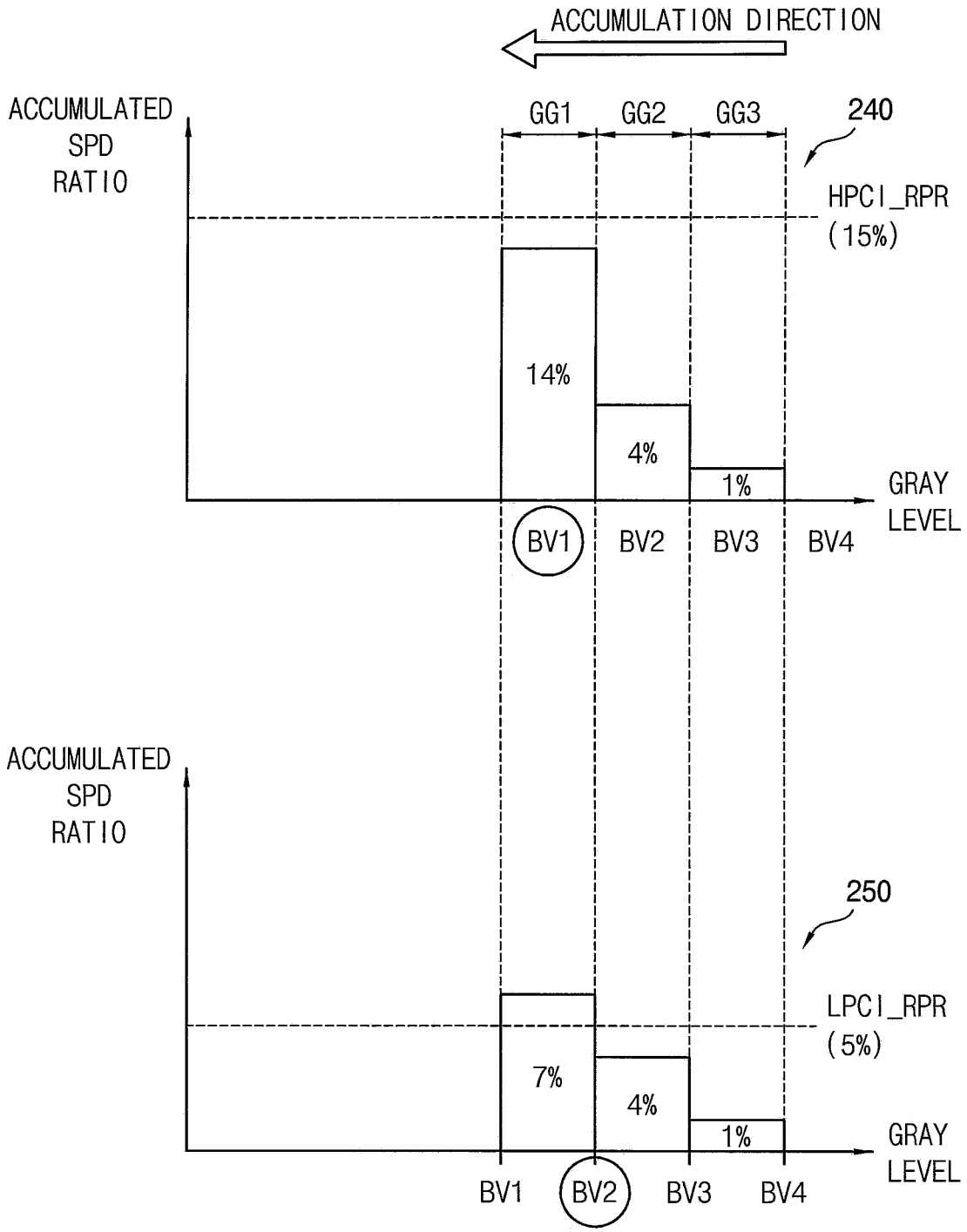
FIG. 5 is a diagram illustrating an example of determining an effective maximum gray level by a histogram analysis block illustrated in FIG. 1 based on a high pure color index histogram and a low pure color index histogram.

FIG. 1 is a block diagram illustrating a display device according to example embodiments. FIG. 2 is a circuit diagram illustrating an example of a sub-pixel included in a display device according to example embodiments. For example, the sub-pixel shown in FIG. 2 may be a representative sub-pixel of each of the sub-pixels included in the display device according to example embodiments. FIG. 3 is a diagram illustrating an example of equations used by a pure color index calculation block illustrated in FIG. 1. FIG. 4 is a diagram illustrating an example of a high pure color index histogram and a low pure color index histogram generated by a pure color index histogram generation block illustrated in FIG. 1. FIG. 5 is a diagram illustrating an example of determining an effective maximum gray level by a histogram analysis block illustrated in FIG. 1 based on a high pure color index histogram and a low pure color index histogram. FIG. 6 is a diagram illustrating an example of a lookup table included in a power supply voltage control block illustrated in FIG. 1.

Referring to FIG. 1, a display device 100 according to example embodiments may include a display panel 110, a data driver 120, a scan driver 130, a power supply unit (e.g., a power supply) 140, and a controller 150. The display panel 110 may include first color sub-pixels RSP, second color sub-pixels GSP, and third color sub-pixels BSP. The data driver 120 may provide data signals DS to the display panel 110. The scan driver 130 may provide scan signals SS to the display panel 110. The power supply unit 140 may provide a first power supply voltage (e.g., a high power supply voltage) ELVDD and a second power supply voltage (e.g., a low power supply voltage) ELVSS to the display panel 110. The controller 150 may control the data driver 120, the scan driver 130, and the power supply unit 140.

The display panel 110 may include a plurality of pixels PX, and each pixel PX may include the first color sub-pixel RSP, the second color sub-pixel GSP, and the third color sub-pixel BSP. In some example embodiments, the first color sub-pixel RSP may be a red sub-pixel RSP that emits red light, the second color sub-pixel GSP may be a green sub-pixel GSP that emits green light, and the third color sub-pixel BSP may be a blue sub-pixel BSP that emits blue light. Further, in some example embodiments, each of the sub-pixels RSP, GSP, and BSP may include at least one capacitor, at least two transistors, and an organic light emitting diode (OLED). In this case, the display panel 110 may be an OLED display panel.

For example, as illustrated in FIG. 2, each of the sub-pixels RSP, GSP, and BSP may include a first switching transistor TSW1, a storage capacitor CST, a driving transistor TDR, the OLED EL, and a second switching transistor TSW2.

The first switching transistor TSW1 may transfer the data signal DS to the storage capacitor CST in response to the scan signal SS. For example, the first switching transistor TSW1 may include a first terminal to receive the data signal DS, a second terminal coupled to a first electrode of the storage capacitor CST, and a gate to receive the scan signal SS output from the scan driver 130.

The storage capacitor CST may store the data signal DS transferred through the first switching transistor TSW1. For example, the storage capacitor CST may include the first electrode coupled to the second terminal of the first switching transistor TSW1 and a gate of the driving transistor TDR, and a second electrode coupled to a second terminal of the driving transistor TDR, an anode of the OLED EL, and a first terminal of the second switching transistor TSW2.

The driving transistor TDR may generate a driving current according to (e.g., based on) the data signal DS stored in the storage capacitor CST. For example, the driving transistor TDR may include a first terminal coupled to a line (e.g., a first power line) of the first power supply voltage ELVDD, the second terminal coupled to the second electrode of the storage capacitor CST, and the gate coupled to the first electrode of the storage capacitor CST.

The OLED EL may emit light according to (e.g., based on) the driving current generated by the driving transistor TDR. For example, the OLED EL may include the anode coupled to the second terminal of the driving transistor TDR, and a cathode coupled to a line (e.g., a second power line) of the second power supply voltage ELVSS.

The second switching transistor TSW2 may couple a node connected between the driving transistor TDR and the OLED EL to a sensing line SL (or an initialization line IL) in response to a sense signal SENSES. For example, the second switching transistor TSW2 may include the first terminal coupled to the node, a second terminal coupled to the sensing line SL (or the initialization line IL), and a gate to receive the sense signal SENSES. In an example embodiment, the sense signal SENSES may be output from the scan driver 130.

Although FIG. 2 illustrates an example where each sub-pixel RSP, GSP, and BSP has a 3 transistor and 1 capacitor structure (3T1C structure) including three transistors TSW1, TDR, and TSW2, and one storage capacitor CST, the present disclosure is not limited thereto. For example, the sub-pixels RSP, GSP, and BSP may have any other suitable pixel structures as would be known to those skilled in the art. In other example embodiments, the display panel 110 may be a liquid crystal display (LCD) panel, or any other suitable display panel as would be known to those skilled in the art.

The data driver 120 may provide the data signals DS to the plurality of pixels PX according to (e.g., based on) output image data ODAT and a data control signal DCTRL received from the controller 150. In some example embodiments, the data control signal DCTRL may include, an output data enable signal, a horizontal start signal, and a load signal, but the present disclosure is not limited thereto. In some example embodiments, the data driver 120 and the controller 150 may be implemented with a single integrated circuit, and the single integrated circuit may be referred to as a timing controller embedded data driver (TED). In other example embodiments, the data driver 120 and the controller 150 may be implemented with separate integrated circuits. For example, the data driver 120 and the controller 150 may be implemented with integrated circuits that are different from each other.

The scan driver 130 may provide the scan signals SS to the plurality of pixels PX according to (e.g., based on) a scan control signal SCTRL received from the controller 150. In some example embodiments, the scan control signal SCTRL may include, a scan start signal and a scan clock signal, but the present disclosure is not limited thereto. In some example embodiments, the scan driver 130 may be integrated or formed at (e.g., in or on) a peripheral portion of the display panel 110. In other example embodiments, the scan driver 130 may be implemented with (e.g., in the form of) an integrated circuit.

The power supply unit 140 may generate the first power supply voltage ELVDD and the second power supply voltage ELVSS according to (e.g., based on) a power control signal PCTRL. For example, the power supply unit 140 may receive the power control signal PCTRL from the controller 150. The power supply unit 140 may provide the first power supply voltage ELVDD and the second power supply voltage ELVSS to the plurality of pixels PX. In some example embodiments, the power control signal PCTRL may include a power supply voltage control signal EVDCS for controlling a voltage level of the first power supply voltage ELVDD (and/or the second power supply voltage ELVSS). In some example embodiments, the power supply unit 140 may be implemented with (e.g., in the form of) an integrated circuit, and the integrated circuit may be referred to as a power management integrated circuit (PMIC). In other example embodiments, the power supply unit 140 may be included in the controller 150 or the data driver 120.

The controller (e.g., a timing controller (TCON)) 150 may receive input image data IDAT and a control signal CTRL from an external host (e.g., an application processor (AP), a graphic processing unit (GPU), a graphic card, and/or the like). In some example embodiments, the input image data IDAT may include (or may be) RGB data including red sub-pixel data, green sub-pixel data, and blue sub-pixel data. Further, in some example embodiments, the control signal CTRL may include, a vertical synchronization signal, a horizontal synchronization signal, an input data enable signal, a master clock signal, and/or the like, but the present disclosure is not limited thereto. The controller 150 may generate the output image data ODAT, the data control signal DCTRL, and the scan control signal SCTRL according to (e.g., based on) the input image data IDAT and the control signal CTRL. The controller 150 may control an operation of the data driver 120 by providing the output image data ODAT and the data control signal DCTRL to the data driver 120, and may control an operation of the scan driver 130 by providing the scan control signal SCTRL to the scan driver 130. Further, the controller 150 may control an operation of the power supply unit 140 by providing the power control signal PCTRL to the power supply unit 140.

As illustrated in FIG. 2, a voltage difference between the first power supply voltage ELVDD and the second power supply voltage ELVSS may be sufficiently large (e.g., sufficiently high or sufficiently great) by considering not only a drain-source voltage VDS of the driving transistor TDR and a voltage VEL applied to the OLED EL, but also by considering a voltage drop (e.g., an IR drop) margin IRDM of the first power supply voltage ELVDD. If the voltage difference between the first power supply voltage ELVDD and the second power supply voltage ELVSS is set to be excessively large, power consumption of the display device 100 may be excessively increased. To reduce the power consumption, a comparative display device detects the maximum gray level of the input image data IDAT, and decreases the first power supply voltage ELVDD according to the maximum gray level. However, in the comparative display device, the first power supply voltage ELVDD may be excessively decreased, and thus, a distortion (e.g., a chrominance distortion) of an image displayed by the comparative display device may occur.

However, the display device 100 according to one or more example embodiments of the present disclosure may adjust the first power supply voltage ELVDD (and/or the second power supply voltage ELVSS) in consideration of pure color indexes of a plurality of sub-pixels RSP, GSP, and BSP, to reduce the power consumption while preventing or reducing the chrominance (or color difference) distortion. For example, the controller 150 of the display device 100 according to one or more example embodiments may include a pure color index (PCI) calculation block (e.g., a PCI calculator) 160, a PCI histogram generation block (e.g., a PCI histogram generator) 170, a histogram analysis block (e.g., a histogram analyzer) 180, and a power supply voltage (e.g., ELVDD) control block (e.g., a power supply voltage controller) 190.

The input image data DAT may include first, second, and third sub-pixel data for the first, second, and third color sub-pixels RSP, GSP, and BSP, and the PCI calculation block 160 may calculate first, second, and third PCIs of the first, second, and third sub-pixel data. In some example embodiments, with respect to each pixel PX, the PCI calculation block 160 may calculate the first, second, and third PCIs of the first, second, and third sub-pixel data for the first, second, and third color sub-pixels RSP, GSP, and BSP included in the pixel PX.

For example, with respect to each pixel PX, the PCI calculation block 160 may calculate the first, second, and third PCIs of the first, second, and third sub-pixel data by using first, second, and third equations 210, 220, and 230 illustrated in FIG. 3. In other words, the PCI calculation block 160 may calculate the first PCI (e.g., PCI_RDAT) of the first sub-pixel data for the first color sub-pixel RSP by using the first equation 210, "PCI_RDAT=RDAT−MAX (GDAT, BDAT)". Here, PCI_RDAT may represent the first PCI of the first sub-pixel data, RDAT may represent the first sub-pixel data for the first color sub-pixel RSP of the pixel PX, GDAT may represent the second sub-pixel data for the second color sub-pixel GSP of the pixel PX, and BDAT may represent the third sub-pixel data for the third color sub-pixel BSP of the pixel PX. In other words, with respect to each pixel PX, the PCI calculation block 160 may calculate the first PCI of the first sub-pixel data for the pixel PX (e.g., the first color sub-pixel RSP of the pixel PX) by subtracting a higher (e.g., a greater) one from among a gray level of the second sub-pixel data for the pixel PX and a gray level of the third sub-pixel data for the pixel PX from a gray level of the first sub-pixel data for the pixel PX. Further, in some example embodiments, when each calculated PCI is less than 0, the PCI may be determined to be 0. For example, in a case where the first, second, and third sub-pixel data for the pixel PX represent a 150-gray level, a 30-gray level, and a 10-gray level, respectively, the first PCI of the first sub-pixel data may be calculated as "150−MAX(30, 10)=120".

In addition, the PCI calculation block 160 may calculate the second PCI (e.g., PCI_GDAT) of the second sub-pixel data for the second color sub-pixel GSP by using the second equation 220, "PCI_GDAT=GDAT−MAX(RDAT, BDAT)". Here, PCI_GDAT may represent the second PCI of the second sub-pixel data. In other words, with respect to each pixel PX, the PCI calculation block 160 may calculate the second PCI of the second sub-pixel data for the pixel PX (e.g., the second color sub-pixel GSP of the pixel PX) by subtracting a higher (e.g., a greater) one from among the gray level of the first sub-pixel data for the pixel PX and the gray level of the third sub-pixel data for the pixel PX from the gray level of the second sub-pixel data for the pixel PX. For example, in a case where the first, second, and third sub-pixel data for the pixel PX represent the 150-gray level, the 30-gray level, and the 10-gray level, respectively, the second PCI of the second sub-pixel data may be determined to be "0," because a result of the second equation 220 (e.g., "30−MAX(150, 10)=−120") is less than 0.

Further, the PCI calculation block 160 may calculate the third PCI (e.g., PCI_BDAT) of the third sub-pixel data for the third color sub-pixel BSP by using the third equation 230, "PCI_BDAT=BDAT−MAX(RDAT, GDAT)". Here, PCI_BDAT may represent the third PCI of the third sub-pixel data. In other words, with respect to each pixel PX, the PCI calculation block 160 may calculate the third PCI of the third sub-pixel data for the pixel PX (e.g., the third color sub-pixel BSP of the pixel PX) by subtracting a higher (e.g., a greater) one from among the gray level of the first sub-pixel data for the pixel PX and the gray level of the second sub-pixel data for the pixel PX from the gray level of the third sub-pixel data for the pixel PX. For example, in a case where the first, second, and third sub-pixel data for the pixel PX represent the 150-gray level, the 30-gray level, and the 10-gray level, respectively, the third PCI of the third sub-pixel data may be determined to be "0," because a result of the third equation 230 (e.g., "10−MAX(150, 30)=−140") is less than 0.

The PCI histogram generation block 170 may divide the first, second, and third sub-pixel data into first, second, and third high pure color sub-pixel data, and first, second, and third low pure color sub-pixel data according to the first, second, and third PCIs. The PCI histogram generation block 170 may generate first, second, and third high PCI histograms according to (e.g., based on) gray levels of the first, second, and third high pure color sub-pixel data, and may generate first, second, and third low PCI histograms according to (e.g., based on) gray levels of the first, second, and third low pure color sub-pixel data.

For example, as illustrated in FIG. 4, the PCI histogram generation block 170 may divide the first sub-pixel data into the first high pure color sub-pixel data and the first low pure color sub-pixel data by comparing the first PCIs of the first sub-pixel data included in the input image data DAT with a PCI threshold value PCI_TH. For example, in a case where the PCI threshold value PCI_TH is 101, the first sub-pixel data having the first PCIs that are greater than or equal to 101 may be classified as the first high pure color sub-pixel data, and the first sub-pixel data having the first PCIs that are less than 101 may be classified as the first low pure color sub-pixel data. In some example embodiments, the PCI histogram generation block 170 may receive a PCI threshold parameter PCITHP, and the PCI threshold value PCI_TH used by the PCI histogram generation block 170 may be determined (e.g., may be set) according to the PCI threshold parameter PCITHP.

The PCI histogram generation block 170 may generate the first high PCI histogram HPCI_HIS indicating numbers of the first high pure color sub-pixel data (e.g., # of SPD) respectively belonging to a plurality of gray groups GG1, GG2, and GG3 by grouping the first high pure color sub-pixel data into the plurality of gray groups GG1, GG2, and GG3 according to the gray levels of the first high pure color sub-pixel data. For example, the PCI histogram generation block 170 may group the first high pure color sub-pixel data into a first group GG1, a second group GG2, and a third group GG3. The first group GG1 may have gray levels that are greater than or equal to a 190-gray level 190G and less than a 210-gray level 210G. The second group GG2 may have gray levels that are greater than or equal to a 210-gray level 210G and less than a 230-gray level 230G. The third group GG3 may have gray levels that are greater than or equal to a 230-gray level 230G and less than a 250-gray level 250G. The PCI histogram generation block 170 may generate the first high PCI histogram HPCI_HIS indicating the numbers of the first high pure color sub-pixel data respectively belonging to the first group GG1, the second group GG2, and the third group GG3. Although FIG. 4 illustrates an example where the histograms HPCI_HIS and LPCI_HIS are generated for a portion (e.g., from the 190-gray level 190G to the 250-gray level 250G) of an entire range of gray levels (e.g., from a 0-gray level to a 255-gray level), the gray levels for which the histograms HPCI_HIS and LPCI_HIS are generated according to various example embodiments may not be limited to the example shown in FIG. 4. For example, the gray levels for which the histograms HPCI_HIS and LPCI_HIS are generated may correspond to another portion of the entire range of gray levels, or may be generated for the entire range of gray levels. Further, in some example embodiments, the PCI histogram generation block 170 may receive gray group boundary parameters GGBP1, GGBP2, GGBP3, and GGBP4, and boundary values BV1, BV2, BV3, and BV4 between the plurality of gray groups GG1, GG2, and GG3 used in the PCI histogram generation block 170 may be determined (e.g., may be set) according to the gray group boundary parameters GGBP1, GGBP2, GGBP3, and GGBP4.

Further, the PCI histogram generation block 170 may generate the first low PCI histogram LPCI_HIS indicating numbers of the first low pure color sub-pixel data (e.g., # of SPD) respectively belonging to the plurality of gray groups GG1, GG2, and GG3 by grouping the first low pure color sub-pixel data into the plurality of gray groups GG1, GG2, and GG3 according to the gray levels of the first low pure color sub-pixel data. For example, the PCI histogram generation block 170 may group the first low pure color sub-pixel data into the first group GG1, the second group GG2, and the third group GG3. The first group GG1 may have gray levels that are greater than or equal to the 190-gray level 190G and less than the 210-gray level 210G. The second group GG2 may have gray levels that are greater than or equal to the 210-gray level 210G and less than the 230-gray level 230G. The third group GG3 may have gray levels that are greater than or equal to the 230-gray level 230G and less than the 250-gray level 250G. The PCI histogram generation block 170 may generate the first low PCI histogram LPCI_HIS indicating the numbers of the first low pure color sub-pixel data respectively belonging to the first group GG1, the second group GG2, and the third group GG3.

The PCI histogram generation block 170 may also perform the sub-pixel data division according to the PCI, the generation of the high PCI histogram HPCI_HIS, and the generation of the low PCI histogram LPCI_HIS with respect to the second sub-pixel data for the second color sub-pixels GSP and the third sub-pixel data for the third color sub-pixels BSP. In other words, the PCI histogram generation block 170 may divide the second sub-pixel data into the second high pure color sub-pixel data and the second low pure color sub-pixel data by comparing the second PCIs of the second sub-pixel data with the PCI threshold value PCI_TH. Similarly, the PCI histogram generation block 170 may divide the third sub-pixel data into the third high pure color sub-pixel data and the third low pure color sub-pixel data by comparing the third PC's of the third sub-pixel data with the PCI threshold value PCI_TH. Further, the PCI histogram generation block 170 may generate the second high PCI histogram HPCI_HIS indicating the numbers of the second high pure color sub-pixel data belonging to the plurality of gray groups GG1, GG2, and GG3 by grouping the second high pure color sub-pixel data into the plurality of gray groups GG1, GG2, and GG3 according to the gray levels of the second high pure color sub-pixel data. The PCI histogram generation block 170 may generate the third high PCI histogram HPCI_HIS indicating the numbers of the third high pure color sub-pixel data belonging to the plurality of gray groups GG1, GG2, and GG3 by grouping the third high pure color sub-pixel data into the plurality of gray groups GG1, GG2, and GG3 according to the gray levels of the third high pure color sub-pixel data. Further, the PCI histogram generation block 170 may generate the second low PCI histogram LPCI_HIS indicating the numbers of the second low pure color sub-pixel data belonging to the plurality of gray groups GG1, GG2, and GG3 by grouping the second low pure color sub-pixel data into the plurality of gray groups GG1, GG2, and GG3 according to the gray levels of the second low pure color sub-pixel data. Similarly, the PCI histogram generation block 170 may generate the third low PCI histogram LPCI_HIS indicating the numbers of the third low pure color sub-pixel data belonging to the plurality of gray groups GG1, GG2, and GG3 by grouping the third low pure color sub-pixel data into the plurality of gray groups GG1, GG2, and GG3 according to the gray levels of the third low pure color sub-pixel data.

The histogram analysis block 180 may determine first, second, and third effective maximum gray levels for the first, second, and third color sub-pixels RSP, GSP, and BPS according to (e.g., based on) the first, second, and third high PCI histograms and the first, second, and third low PCI histograms. In some example embodiments, the histogram analysis block 180 may determine each high pure color effective maximum gray level by comparing a ratio that is accumulated by using a corresponding one of the first, second, and third high PCI histograms with a high pure color reference pixel ratio, and may determine each low pure color effective maximum gray level by comparing a ratio that is accumulated by using a corresponding one of the first, second, and third low PCI histograms with a low pure color reference pixel ratio. The histogram analysis block 180 may determine a corresponding one of the first, second, and third effective maximum gray levels according to (e.g., based on) the high pure color effective maximum gray level and the low pure color effective maximum gray level.

For example, as illustrated in 240 of FIG. 5, the histogram analysis block 180 may accumulate the numbers of the first high pure color sub-pixel data belonging to the plurality of gray groups GG1, GG2, and GG3 of the first high PCI histogram in a direction from the maximum gray group GG3 of the plurality of gray groups GG1, GG2, and GG3 to the minimum gray group GG1 of the plurality of gray groups GG1, GG2, and GG3. The histogram analysis block 180 may compare a ratio of the accumulated numbers of the first high pure color sub-pixel data to a total number of the first high pure color sub-pixel data with the high pure color reference pixel ratio HPCI_RPR to determine a gray group that results in the ratio of the accumulated numbers of the first high pure color sub-pixel data to the total number of the first high pure color sub-pixel data to be greater than or equal to the high pure color reference pixel ratio HPCI_RPR. The histogram analysis block 180 may determine an upper boundary value of the determined gray group as a first high pure color effective maximum gray level. As illustrated in FIG. 5, in a case where the ratio of the accumulated numbers is less than the high pure color reference pixel ratio HPCI_RPR even up to the minimum gray group GG1, the histogram analysis block 180 may determine a lower boundary value BV1 (e.g., the 190-gray level 190G in the examples of FIGS. 4 and 5) of the minimum gray group GG1 as the first high pure color effective maximum gray level.

Further, as illustrated in 250 of FIG. 5, the histogram analysis block 180 may accumulate the numbers of the first low pure color sub-pixel data belonging to the plurality of gray groups GG1, GG2, and GG3 of the first low PCI histogram in the direction from the maximum gray group GG3 to the minimum gray group GG1. The histogram analysis block 180 may compare the ratio of the accumulated numbers of the first low pure color sub-pixel data to a total number of the first low pure color sub-pixel data with the low pure color reference pixel ratio LPCI_RPR to determine a gray group (e.g., GG1 in the example of FIG. 5) that results in the ratio of the accumulated numbers of the first low pure color sub-pixel data to the total number of the first low pure color sub-pixel data to be greater than or equal to the low pure color reference pixel ratio LPCI_RPR. The histogram analysis block 180 may determine an upper boundary value BV2 (e.g., the 210-gray level 210G in the example of FIG. 5) of the determined gray group (e.g., GG1 in the example of FIG. 5) as a first low pure color effective maximum gray level. In a case where the ratio of the accumulated numbers is less than the low pure color reference pixel ratio LPCI_RPR even up to the minimum gray group GG1, the histogram analysis block 180 may determine the lower boundary value BV1 of the minimum gray group GG1 as the first low pure color effective maximum gray level.

The histogram analysis block 180 may determine (e.g., may select) a higher (e.g., a greater) one from among the first high pure color effective maximum gray level and the first low pure color effective maximum gray level as the first effective maximum gray level. For example, in a case where the first high pure color effective maximum gray level is the 190-gray level 190G, and the first low pure color effective maximum gray level is the 210-gray level 210G, the histogram analysis block 180 may determine the first effective maximum gray level to be the 210-gray level 210G.

In some example embodiments, the high pure color reference pixel ratio HPCI_RPR may be greater than (e.g., may be higher than) the low pure color reference pixel ratio LPCI_RPR. For example, as illustrated in FIG. 5, the high pure color reference pixel ratio HPCI_RPR may be about 15%, and the low pure color reference pixel ratio LPCI_RPR may be about 5%. However, the high pure color and low pure color reference pixel ratios HPCI_RPR and LPCI_RPR may not be limited to the example of FIG. 5.

Similarly, the histogram analysis block 180 may further determine the second and third effective maximum gray levels for the second and third color sub-pixels GSP and BSP. For example, the histogram analysis block 180 may determine a second high pure color effective maximum gray level by accumulating the numbers of the second high pure color sub-pixel data belonging to the plurality of gray groups GG1, GG2, and GG3 of the second high PCI histogram in the direction from the maximum gray group GG3 to the minimum gray group GG1, and by comparing a ratio of the accumulated numbers of the second high pure color sub-pixel data to a total number of the second high pure color sub-pixel data with the high pure color reference pixel ratio HPCI_RPR. Similarly, the histogram analysis block 180 may determine a third high pure color effective maximum gray level by accumulating the numbers of the third high pure color sub-pixel data belonging to the plurality of gray groups GG1, GG2, and GG3 of the third high PCI histogram in the direction from the maximum gray group GG3 to the minimum gray group GG1, and by comparing a ratio of the accumulated numbers of the third high pure color sub-pixel data to a total number of the third high pure color sub-pixel data with the high pure color reference pixel ratio HPCI_RPR. Further, the histogram analysis block 180 may determine a second low pure color effective maximum gray level by accumulating the numbers of the second low pure color sub-pixel data belonging to the plurality of gray groups GG1, GG2, and GG3 of the second low PCI histogram in the direction from the maximum gray group GG3 to the minimum gray group GG1, and by comparing a ratio of the accumulated numbers of the second low pure color sub-pixel data to a total number of the second low pure color sub-pixel data with the low pure color reference pixel ratio LPCI_RPR. The histogram analysis block 180 may determine a third low pure color effective maximum gray level by accumulating the numbers of the third low pure color sub-pixel data belonging to the plurality of gray groups GG1, GG2, and GG3 of the third low PCI histogram in the direction from the maximum gray group GG3 to the minimum gray group GG1, and by comparing a ratio of the accumulated numbers of the third low pure color sub-pixel data to a total number of the third low pure color sub-pixel data with the low pure color reference pixel ratio LPCI_RPR. Further, the histogram analysis block 180 may determine a greater one (e.g., a higher one) from among the second high pure color effective maximum gray level and the second low pure color effective maximum gray level as the second effective maximum gray level, and may determine a greater one (e.g., a higher one) from among the third high pure color effective maximum gray level and the third low pure color effective maximum gray level as the third effective maximum gray level.

The power supply voltage control block 190 may determine a voltage level of the first power supply voltage ELVDD (and/or the second power supply voltage ELVSS) according to (e.g., based on) the first, second, and third effective maximum gray levels. The power supply voltage control block 190 may provide the power supply voltage control signal EVDCS indicating the determined voltage level of the first power supply voltage ELVDD (and/or the second power supply voltage ELVSS) to the power supply unit 140, such that the power supply unit 140 generates the first power supply voltage ELVDD (and/or the second power supply voltage ELVSS) having the determined voltage level indicated by the power supply voltage control signal EVDCS.

In some example embodiments, the power supply voltage control block 190 may include a lookup table 260 illustrated in FIG. 6. The lookup table 260 may store the voltage level ELVDD_VL of the first power supply voltage ELVDD corresponding to each of the gray levels GRAY LEVEL. The power supply voltage control block 190 may determine a greater one (e.g., a maximum one) from among the first, second, and third effective maximum gray levels as a maximum gray level, and may determine the voltage level of the first power supply voltage ELVDD corresponding to the maximum gray level by using the lookup table 260. The power supply voltage control block 190 may provide the power supply voltage control signal EVDCS indicating the determined voltage level of the first power supply voltage ELVDD to the power supply unit 140. For example, in a case where the first, second, and third effective maximum gray levels are a 0-gray level 0G, the 0-gray level 0G, and the 0-gray level 0G, the power supply voltage control block 190 may output the power supply voltage control signal EVDCS indicating a voltage level EVDVL0 corresponding to the 0-gray level 0G. Further, in a case where the first, second, and third effective maximum gray levels are a 1-gray level 1G, the 0-gray level 0G, and the 0-gray level 0G, the power supply voltage control block 190 may output the power supply voltage control signal EVDCS indicating a voltage level EVDVL1 corresponding to the 1-gray level 1G. Further, in a case where the first, second, and third effective maximum gray levels are a 100-gray level, a 254-gray level 254G, and the 0-gray level 0G, the power supply voltage control block 190 may output the power supply voltage control signal EVDCS indicating a voltage level EVDVL254 corresponding to the 254-gray level 254G. Further, in a case where the first, second, and third effective maximum gray levels are a 255-gray level 255G, the 254-gray level 254G, and the 0-gray level 0G, the power supply voltage control block 190 may output the power supply voltage control signal EVDCS indicating a voltage level EVDVL255 corresponding to the 255-gray level 255G. Accordingly, the power supply unit 140 may provide the display panel 110 with the first power supply voltage ELVDD having the voltage level determined according to (e.g., based on) the first, second, and third effective maximum gray levels, and the power consumption of the display device 100 may be reduced.

As described above, the display device 100 according to one or more example embodiments may calculate the PC's of the sub-pixel data, may divide the sub-pixel data into the high pure color sub-pixel data and the low pure color sub-pixel data according to the PCIs, may generate the high PCI histograms based on gray levels of the high pure color sub-pixel data, may generate the low PCI histograms based on gray levels of the low pure color sub-pixel data, and may adjust the first power supply voltage ELVDD (and/or the second power supply voltage ELVSS) based on the high PCI histograms and the low PCI histograms. Accordingly, because the first power supply voltage ELVDD (and/or the second power supply voltage ELVSS) is adjusted in consideration of the PCIs, the power consumption of the display device 100, according to one or more example embodiments, may be reduced while preventing or reducing the chrominance distortion. Further, in the display device 100 according to one or more example embodiments, the high pure color reference pixel ratio HPCI_RPR may be greater (e.g., may be higher) than the low pure color reference pixel ratio LPCI_RPR, and thus, the voltage level of the first power supply voltage ELVDD for a high pure color image may be lower than the voltage level of the first power supply voltage ELVDD for a low pure color image. In case of the high pure color image, the chrominance distortion may not be perceived even if the voltage level of the first power supply voltage ELVDD is relatively low, and thus, the power consumption of the display device 100 may be further reduced.

Figure 7:
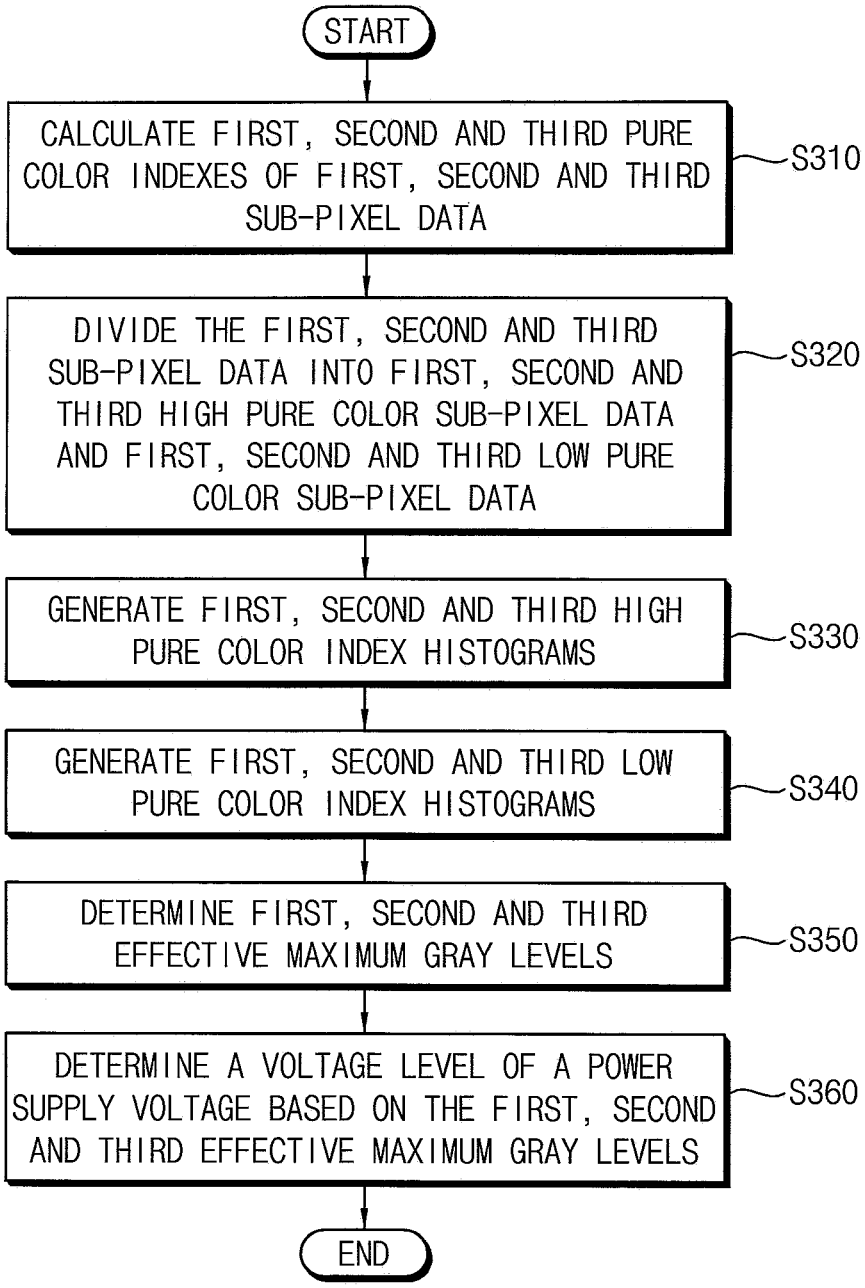
FIG. 7 is a flowchart illustrating a method of determining a power supply voltage provided to a display panel according to example embodiments.

FIG. 7 is a flowchart illustrating a method of determining a power supply voltage provided to a display panel according to example embodiments.

Referring to FIGS. 1 and 7, first, second, and third pure color indexes of first, second, and third sub-pixel data may be calculated (S310). For example, a PCI calculation block (e.g., a PCI calculator) 160 may calculate the first PCIs of the first sub-pixel data for first color sub-pixels RSP of a display panel 110, may calculate the second PCIs of the second sub-pixel data for second color sub-pixels GSP of the display panel 110, and may calculate the third PCIs of the third sub-pixel data for third color sub-pixels BSP of the display panel 110 (S310). For example, with respect to each pixel PX, the PCI calculation block 160 may calculate the first PCI of the first sub-pixel data according to (e.g., by using) the first equation 210 illustrated in FIG. 3, may calculate the second PCI of the second sub-pixel data according to (e.g., by using) the second equation 220 illustrated in FIG. 3, and may calculate the third PCI of the third sub-pixel data according to (e.g., by using) the third equation 230 illustrated in FIG. 3.

The first, second, and third sub-pixel data may be divided into first, second, and third high pure color sub-pixel data, and first, second, and third low pure color sub-pixel data (S320). For example, a PCI histogram generation block (e.g., a PCI histogram generator) 170 may divide the first sub-pixel data into first high pure color sub-pixel data and first low pure color sub-pixel data by comparing the first PCIs with a PCI threshold value, may divide the second sub-pixel data into second high pure color sub-pixel data and second low pure color sub-pixel data by comparing the second PC's with the PCI threshold value, and may divide the third sub-pixel data into third high pure color sub-pixel data and third low pure color sub-pixel data by comparing the third PCIs with the PCI threshold value (S320).

First, second, and third high pure color index histograms may be generated (S330). For example, the PCI histogram generation block 170 may generate a first high PCI histogram indicating the numbers of the first high pure color sub-pixel data belonging to a plurality of gray groups by grouping the first high pure color sub-pixel data into the plurality of gray groups according to gray levels of the first high pure color sub-pixel data. The PCI histogram generation block 170 may generate a second high PCI histogram indicating the numbers of the second high pure color sub-pixel data belonging to the plurality of gray groups by grouping the second high pure color sub-pixel data into the plurality of gray groups according to gray levels of the second high pure color sub-pixel data. The PCI histogram generation block 170 may generate a third high PCI histogram indicating the numbers of the third high pure color sub-pixel data belonging to the plurality of gray groups by grouping the third high pure color sub-pixel data into the plurality of gray groups according to gray levels of the third high pure color sub-pixel data.

Further, first, second, and third low pure color index histograms may be generated (S340). For example, the PCI histogram generation block 170 may generate a first low PCI histogram indicating the numbers of the first low pure color sub-pixel data belonging to the plurality of gray groups by grouping the first low pure color sub-pixel data into the plurality of gray groups according to gray levels of the first low pure color sub-pixel data (S340). The PCI histogram generation block 170 may generate a second low PCI histogram indicating the numbers of the second low pure color sub-pixel data belonging to the plurality of gray groups by grouping the second low pure color sub-pixel data into the plurality of gray groups according to gray levels of the second low pure color sub-pixel data (S340). The PCI histogram generation block 170 and may generate a third low PCI histogram indicating the numbers of the third low pure color sub-pixel data belonging to the plurality of gray groups by grouping the third low pure color sub-pixel data into the plurality of gray groups according to gray levels of the third low pure color sub-pixel data (S340).

First, second, and third effective maximum gray levels may be determined (S350). For example, a histogram analysis block (e.g., a histogram analyzer) 180 may determine the first, second, and third effective maximum gray levels for the first, second, and third color sub-pixels RSP, GSP, and BSP according to (e.g., based on) the first, second, and third high PCI histograms and the first, second, and third low PCI histograms (S350). For example, the histogram analysis block 180 may determine a first high pure color effective maximum gray level by accumulating the numbers of the first high pure color sub-pixel data belonging to the plurality of gray groups of the first high PCI histogram in a direction from a maximum gray group of the plurality of gray groups to a minimum gray group of the plurality of gray groups, and by comparing a ratio of the accumulated numbers of the first high pure color sub-pixel data to a total number of the first high pure color sub-pixel data with a high pure color reference pixel ratio. In addition, the histogram analysis block 180 may determine a second high pure color effective maximum gray level by accumulating the numbers of the second high pure color sub-pixel data belonging to the plurality of gray groups of the second high PCI histogram in the direction from the maximum gray group to the minimum gray group, and by comparing a ratio of the accumulated numbers of the second high pure color sub-pixel data to a total number of the second high pure color sub-pixel data with the high pure color reference pixel ratio. Further, the histogram analysis block 180 may determine a third high pure color effective maximum gray level by accumulating the numbers of the third high pure color sub-pixel data belonging to the plurality of gray groups of the third high PCI histogram in the direction from the maximum gray group to the minimum gray group, and by comparing a ratio of the accumulated numbers of the third high pure color sub-pixel data to a total number of the third high pure color sub-pixel data with the high pure color reference pixel ratio.

Similarly, the histogram analysis block 180 may determine a first low pure color effective maximum gray level by accumulating the numbers of the first low pure color sub-pixel data belonging to the plurality of gray groups of the first low PCI histogram in the direction from the maximum gray group to the minimum gray group, and by comparing a ratio of the accumulated numbers of the first low pure color sub-pixel data to a total number of the first low pure color sub-pixel data with a low pure color reference pixel ratio. In addition, the histogram analysis block 180 may determine a second low pure color effective maximum gray level by accumulating the numbers of the second low pure color sub-pixel data belonging to the plurality of gray groups of the second low PCI histogram in the direction from the maximum gray group to the minimum gray group, and by comparing a ratio of the accumulated numbers of the second low pure color sub-pixel data to a total number of the second low pure color sub-pixel data with the low pure color reference pixel ratio. Further, the histogram analysis block 180 may determine a third low pure color effective maximum gray level by accumulating the numbers of the third low pure color sub-pixel data belonging to the plurality of gray groups of the third low PCI histogram in the direction from the maximum gray group to the minimum gray group, and by comparing a ratio of the accumulated numbers of the third low pure color sub-pixel data to a total number of the third low pure color sub-pixel data with the low pure color reference pixel ratio.

The histogram analysis block 180 may determine a greater one (e.g., a higher one) from among the first high pure color effective maximum gray level and the first low pure color effective maximum gray level as the first effective maximum gray level. The histogram analysis block 180 may determine a greater one (e.g., a higher one) from among the second high pure color effective maximum gray level and the second low pure color effective maximum gray level as the second effective maximum gray level. The histogram analysis block 180 may determine a greater one (e.g., a higher one) from among the third high pure color effective maximum gray level and the third low pure color effective maximum gray level as the third effective maximum gray level. In some example embodiments, the high pure color reference pixel ratio may be greater than (e.g., may be higher than) the low pure color reference pixel ratio.

A voltage level of a power supply voltage may be determined according to (e.g., based on) the first, second, and third effective maximum gray levels (S360). For example, a power supply voltage control block (e.g., a power supply voltage controller) 190 may determine a voltage level of a power supply voltage ELVDD based on the first, second, and third effective maximum gray levels (S360). For example, the power supply voltage control block 190 may include a lookup table that stores the voltage level of the first power supply voltage ELVDD corresponding to each of the gray levels. The power supply voltage control block 190 may determine a greater one (e.g., a maximum one) from among the first, second, and third effective maximum gray levels as a maximum gray level, and may determine the voltage level of the power supply voltage ELVDD corresponding to the maximum gray level by using the lookup table. The power supply voltage control block 190 may provide a power supply voltage control signal EVDCS indicating the determined voltage level of the power supply voltage ELVDD to a power supply unit (e.g., a power supply) 140. Accordingly, because the power supply voltage ELVDD is adjusted in consideration of the PCIs, power consumption of the display device 100 may be reduced while preventing or reducing a chrominance distortion.

Figure 8:
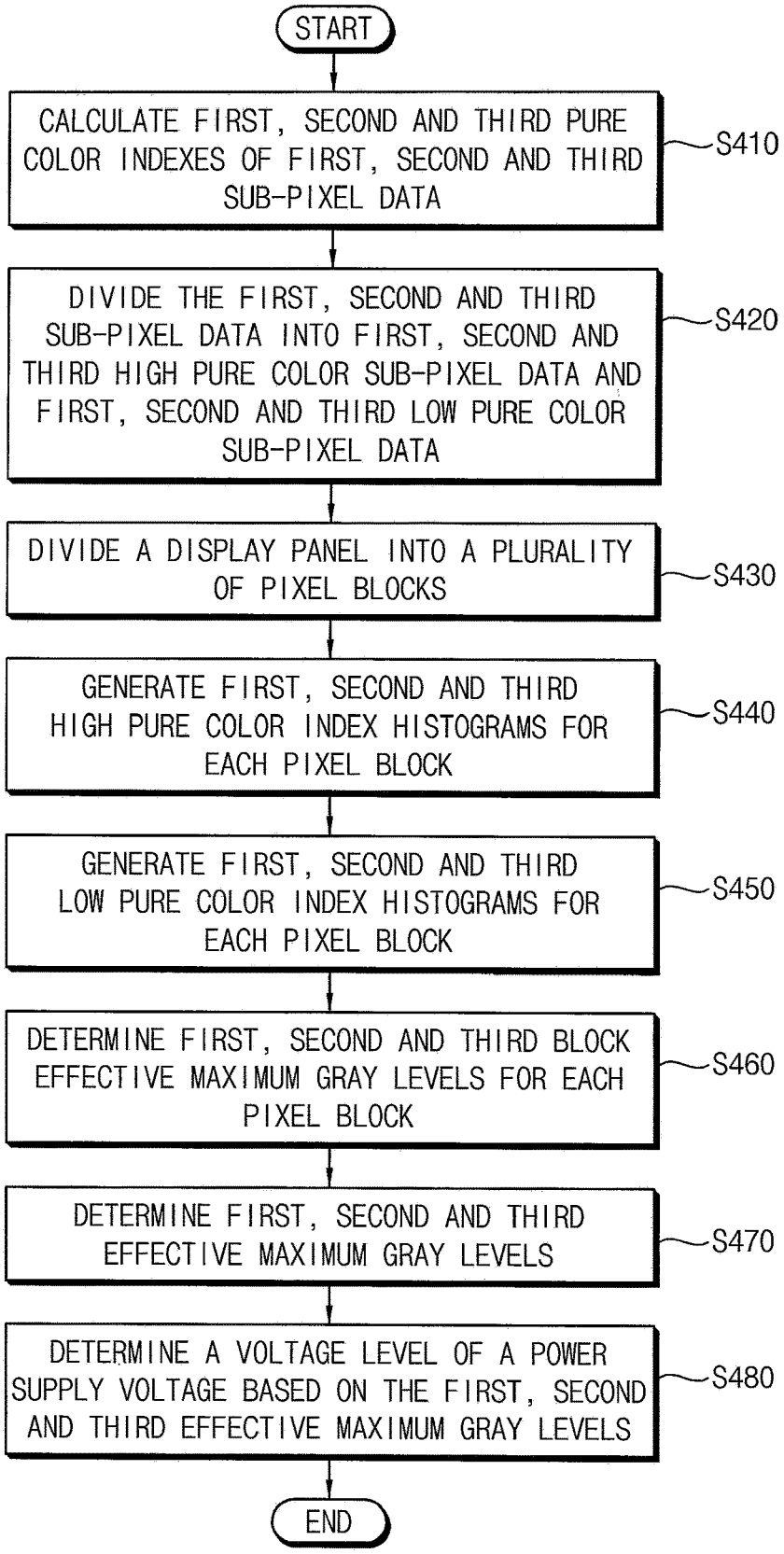
FIG. 8 is a flowchart illustrating a method of determining a power supply voltage provided to a display panel according to example embodiments.
Figure 9:
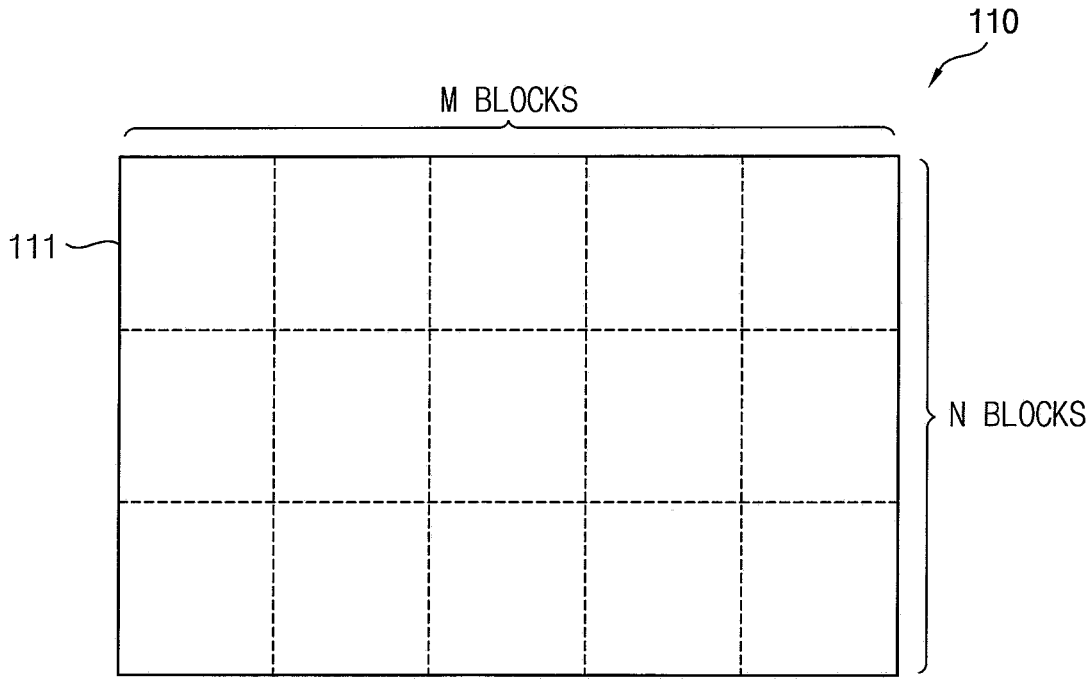
FIG. 9 is a diagram illustrating an example of dividing a display panel into a plurality of pixel blocks according to the method of FIG. 8.

FIG. 8 is a flowchart illustrating a method of determining a power supply voltage provided to a display panel according to example embodiments, and FIG. 9 is a diagram illustrating an example of dividing a display panel into a plurality of pixel blocks according to the method of FIG. 8.

The method of FIG. 8 may be the same or substantially the same as (or similar to) the method of FIG. 7, except in the method of FIG. 8, a display panel may be divided into a plurality of pixel blocks (S430), high and low PCI histograms may be generated with respect to each pixel block (S440 and S450), and first, second, and third effective maximum gray levels may be determined according to (e.g., based on) first, second, and third block effective maximum gray levels for the plurality of pixel blocks (S460 and S470).

In more detail, referring to FIGS. 1 and 8, first, second, and third pure color indexes of first, second, and third sub-pixel data may be calculated (S410). For example, a PCI calculation block (e.g., a PCI calculator) 160 may calculate the first, second, and third PCIs of the first, second, and third sub-pixel data for first, second, and third color sub-pixels RSP, GSP, and BSP (S410). The first, second, and third sub-pixel data may be divided into first, second, and third high pure color sub-pixel data and first, second, and third low pure color sub-pixel data (S420). For example, a PCI histogram generation block (e.g., a PCI histogram generator) 170 may divide the first, second, and third sub-pixel data into first, second, and third high pure color sub-pixel data, and first, second, and third low pure color sub-pixel data according to the first, second, and third PCIs (S420).

As illustrated in FIG. 9, a display panel 110 may be divided into a plurality of pixel blocks 111 (S430). For example, the display panel 110 may be divided into N block rows and M block columns (where each of N and M may be an integer greater than 0), and thus, the display panel 110 may be divided into N×M pixel blocks 111. Further, first, second, and third high PCI histograms may be generated for each pixel block (S440), and first, second, and third low PCI histograms may be generated for each pixel block (S450). For example, the PCI histogram generation block 170 may generate the first, second and third high PCI histograms for each pixel block 111 according to gray levels of the first, second, and third high pure color sub-pixel data for each pixel block 111 (S440), and may generate first, second, and third low PCI histograms for each pixel block 111 according to gray levels of the first, second, and third low pure color sub-pixel data for each pixel block 111 (S450).

First, second, and third block effective maximum gray levels for each pixel block may be determined (S460). For example, a histogram analysis block (e.g., a histogram analyzer) 180 may determine a plurality of first block effective maximum gray levels, a plurality of second block effective maximum gray levels, and a plurality of third block effective maximum gray levels for the plurality of pixel blocks 111 (S460). For example, with respect to each pixel block 111, the histogram analysis block 180 may determine first, second, and third high pure color block effective maximum gray levels according to (e.g., based on) the first, second, and third high PCI histograms, and may determine first, second, and third low pure color block effective maximum gray levels according to (e.g., based on) the first, second, and third low PCI histograms. The histogram analysis block 180 may determine greater ones (e.g., higher ones) from among the first, second, and third high pure color block effective maximum gray levels and the first, second, and third low pure color block effective maximum gray levels as the first, second, and third block effective maximum gray levels for the pixel block 111.

First, second, and third effective maximum gray levels may be determined (S470). For example, the histogram analysis block 180 may determine a greater one (e.g., a maximum one) from among the plurality of first block effective maximum gray levels as a first effective maximum gray level, a greater one (e.g., a maximum one) from among the plurality of second block effective maximum gray levels as a second effective maximum gray level, and a greater one (e.g., a maximum one) of the plurality of third block effective maximum gray levels as a third effective maximum gray level (S470).

A voltage level of a power supply voltage may be determined according to (e.g., based on) the first, second, and third effective maximum gray levels (S480). For example, a power supply voltage control block (e.g., a power supply voltage controller) 190 may determine a voltage level of a power supply voltage ELVDD according to (e.g., based on) the first, second, and third effective maximum gray levels (S480). Accordingly, because the power supply voltage ELVDD is adjusted in consideration of the PCIs, power consumption of the display device 100 may be reduced while preventing or reducing a chrominance distortion.

Figure 10:
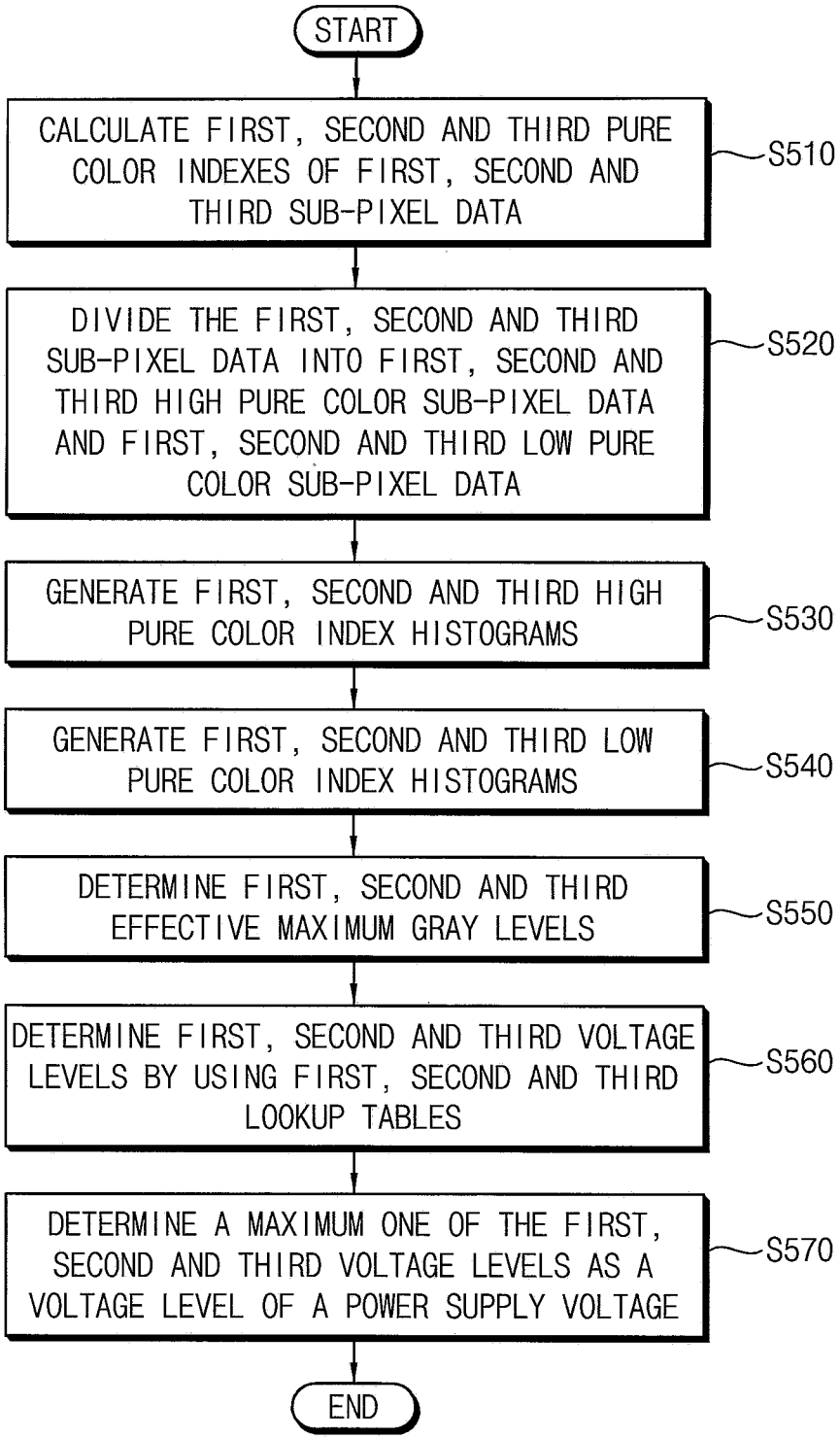
FIG. 10 is a flowchart illustrating a method of determining a power supply voltage provided to a display panel according to example embodiments.
Figure 11:
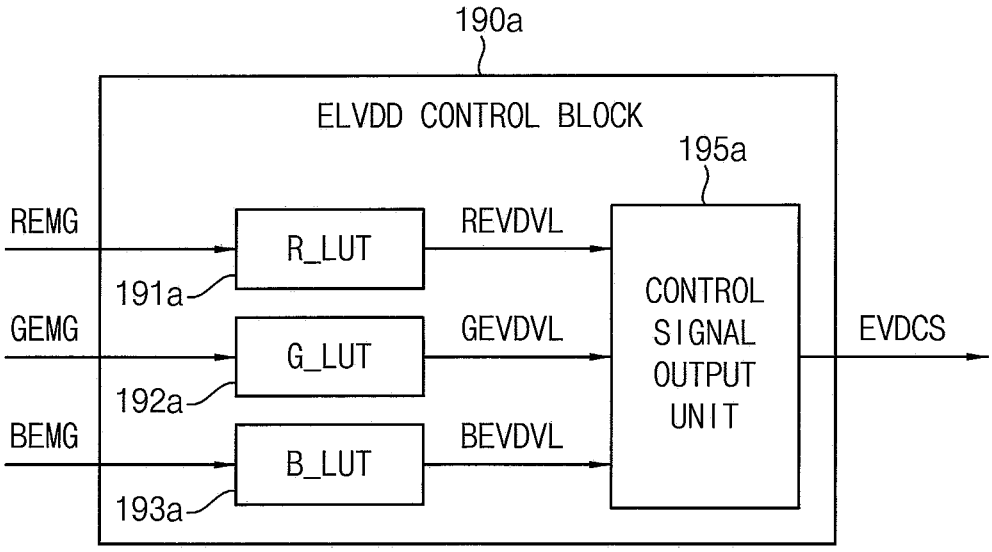
FIG. 11 is a block diagram illustrating an example of a power supply voltage control block included in a display panel that performs the method of FIG. 10.

FIG. 10 is a flowchart illustrating a method of determining a power supply voltage provided to a display panel according to example embodiments, and FIG. 11 is a block diagram illustrating an example of a power supply voltage control block included in the display panel that performs the method of FIG. 10.

The method of FIG. 10 may be the same or substantially the same as (or similar to) the method of FIG. 7, except in the method of FIG. 10, a voltage level of a power supply voltage may be determined by using first, second, and third lookup tables (S560 and S570).

In more detail, referring to FIGS. 1 and 10, first, second, and third pure color indexes of first, second, and third sub-pixel data may be calculated (S510). For example, a PCI calculation block (e.g., a PCI calculator) 160 may calculate the first, second, and third PCIs of the first, second, and third sub-pixel data for first, second, and third color sub-pixels RSP, GSP, and BSP (S510). The first, second, and third sub-pixel data may be divided into first, second, and third high pure color sub-pixel data, and first, second, and third low pure color sub-pixel data (S520). For example, a PCI histogram generation block (e.g., a PCI histogram generator) 170 may divide the first, second, and third sub-pixel data into the first, second, and third high pure color sub-pixel data, and first, second, and third low pure color sub-pixel data according to the first, second, and third PCIs (S520). First, second, and third high pure color index histograms may be generated (S530), and first, second, and third low pure color index histograms may be generated (S540). For example, the PCI histogram generation block 170 may generate the first, second, and third high PCI histograms according to gray levels of the first, second, and third high pure color sub-pixel data (S530), and may generate the first, second, and third low PCI histograms according to gray levels of the first, second, and third low pure color sub-pixel data (S540). First, second, and third effective maximum gray levels may be determined (S550). For example, a histogram analysis block (e.g., a histogram analyzer) 180 may determine the first, second, and third effective maximum gray levels according to (e.g., based on) the first, second, and third high PCI histograms and the first, second, and third low PCI histograms (S550).

The display device 100 for performing the method of FIG. 10 may include a power supply voltage control block (e.g., a power supply voltage controller) 190*a* illustrated in FIG. 11. The power supply voltage control block 190*a* may include a first lookup table (R_LUT) 191*a*, a second lookup table (G_LUT) 192*a*, and a third lookup table (B_LUT) 193*a*. The first lookup table (R_LUT) 191*a* may store a first voltage level of the power supply voltage ELVDD corresponding to each of the gray levels for the first color sub-pixels RSP. The second lookup table (G_LUT) 192*a* may store a second voltage level of the power supply voltage ELVDD corresponding to each of the gray levels for the second color sub-pixels GSP. The third lookup table (B_LUT) 193*a* may store a third voltage level of the power supply voltage ELVDD corresponding to each of the gray levels for the third color sub-pixels BSP. The first, second, and third voltage levels may be determined by using the first, second, and third lookup tables 191*a*, 192*a*, and 193*a* (S560). For example, the power supply voltage control block 190*a* may determine the first voltage level REVDVL of the power supply voltage ELVDD corresponding to the first effective maximum gray level REMG by using the first lookup table 191*a*. The power supply voltage control block 190*a* may determine the second voltage level GEVDVL of the power supply voltage ELVDD corresponding to the second effective maximum gray level GEMG by using the second lookup table 192*a*. The power supply voltage control block 190*a* may determine the third voltage level BEVDVL of the power supply voltage ELVDD corresponding to the third effective maximum gray level BEMG by using the third lookup table 193*a*.

The power supply voltage control block 190*a* may further include a control signal output unit (e.g., a control signal output module or a control signal output circuit) 195*a*. The control signal output unit 195*a* may determine a greater one (e.g., a maximum one) from among the first, second, and third voltage levels REVDVL, GEVDVL, and BEVDVL as the voltage level of the power supply voltage ELVDD (S570). The control signal output unit 195*a* may provide a power supply voltage control signal EVDCS indicating the determined voltage level of the power supply voltage ELVDD to a power supply unit (e.g., a power supply) 140. Accordingly, because the power supply voltage ELVDD is adjusted in consideration of the PCIs, power consumption of the display device 100 may be reduced while preventing or reducing a chrominance distortion.

Figure 12:
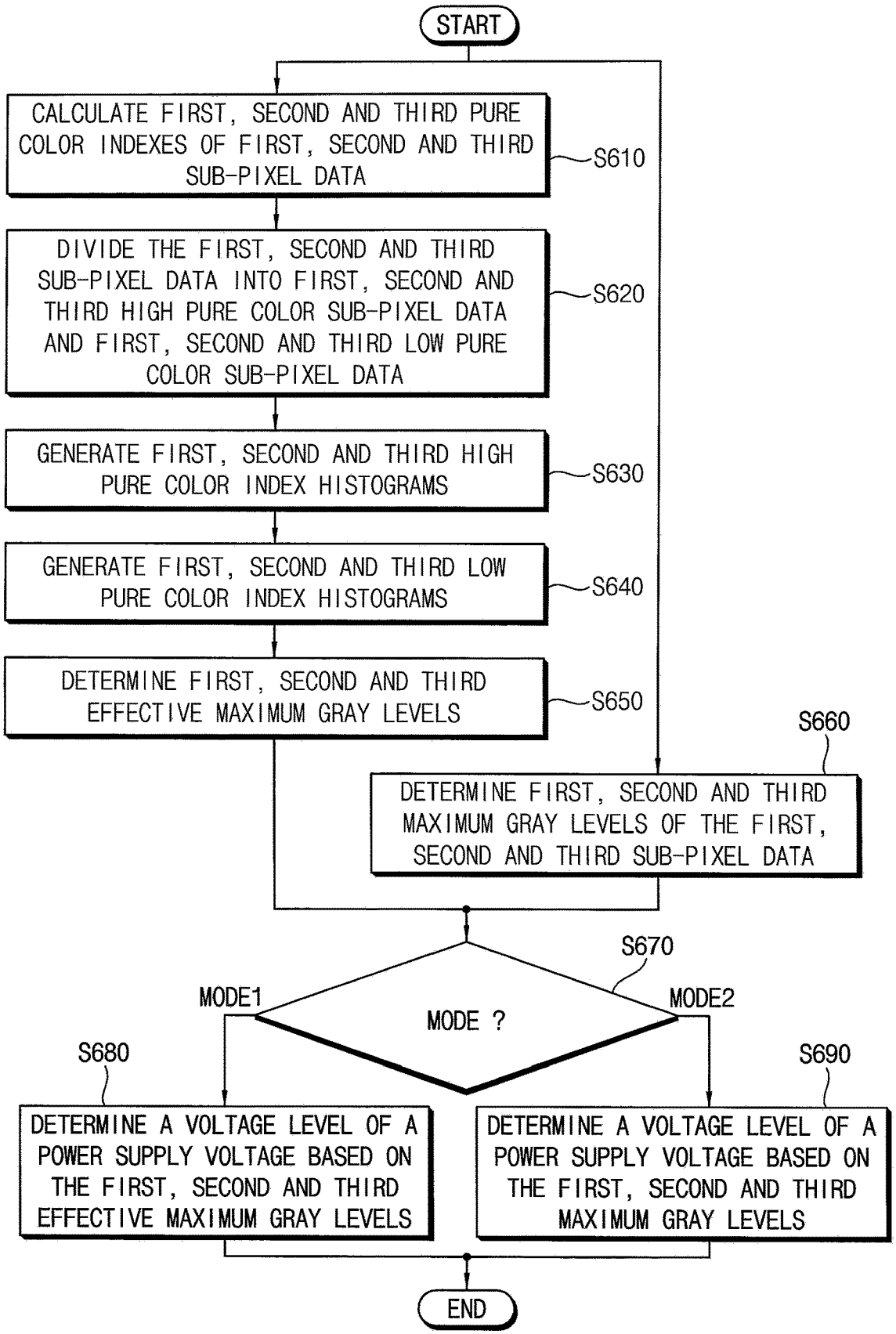
FIG. 12 is a flowchart illustrating a method of determining a power supply voltage provided to a display panel according to example embodiments.
Figure 13:
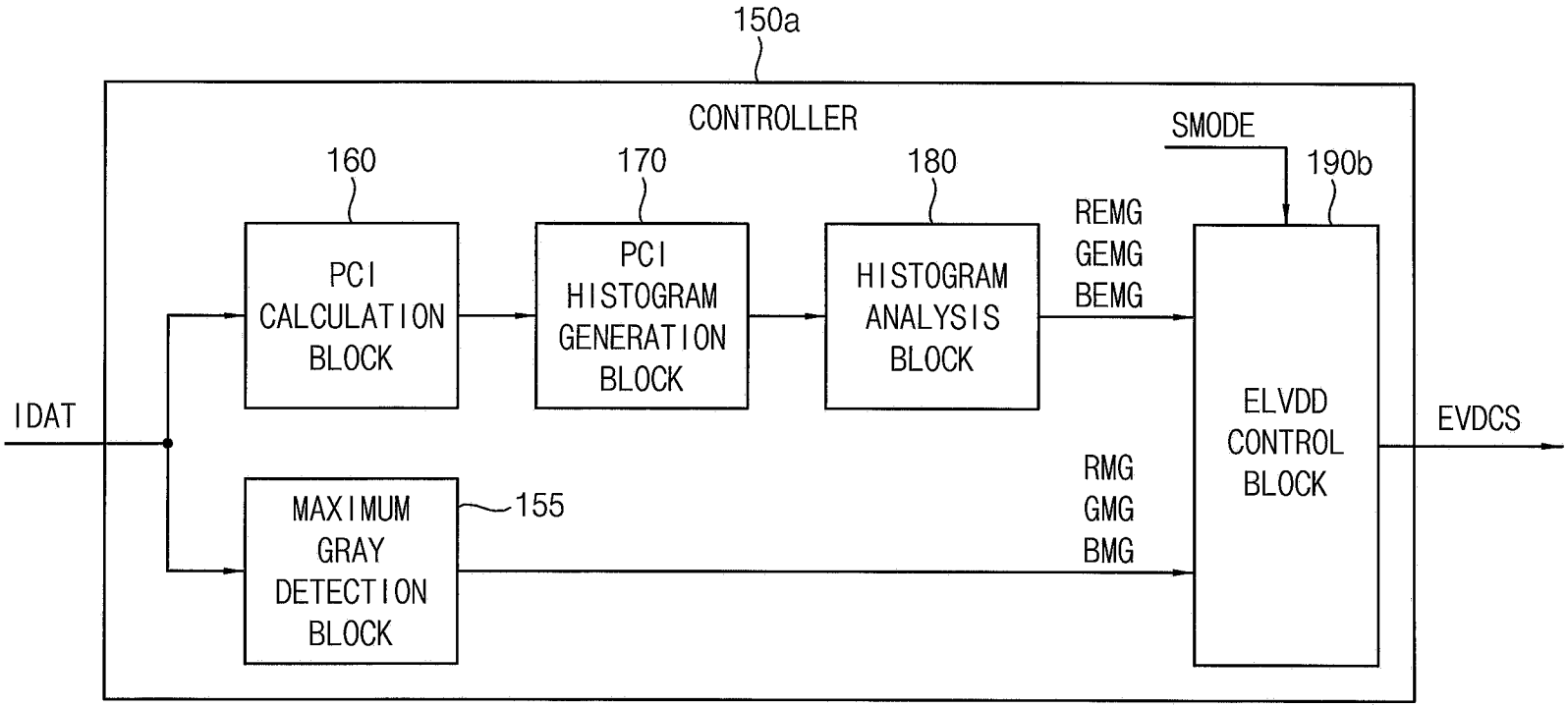
FIG. 13 is a block diagram illustrating an example of a controller included in a display panel that performs the method of FIG. 12.

FIG. 12 is a flowchart illustrating a method of determining a power supply voltage provided to a display panel according to example embodiments, and FIG. 13 is a block diagram illustrating an example of a controller included in a display panel that performs the method of FIG. 12.

The method of FIG. 12 may be the same or substantially the same as (or similar to) the method of FIG. 7, except in the method of FIG. 12, first, second, and third maximum gray levels may be determined (S660), in addition to the first, second, and third effective maximum gray levels, and a voltage level of the power supply voltage may be selectively determined according to (e.g., based on) the first, second, and third effective maximum gray levels or the first, second, and third maximum gray levels according to (e.g., depending on) a mode (S670, S680, and S690).

In more detail, referring to FIGS. 1 and 12, first, second, and third pure color indexes of first, second, and third sub-pixel data may be calculated (S610). For example, a PCI calculation block (e.g., a PCI calculator) 160 may calculate the first, second, and third PCIs of the first, second, and third sub-pixel data for first, second, and third color sub-pixels RSP, GSP, and BSP (S610). The first, second, and third sub-pixel data may be divided into first, second, and third high pure color sub-pixel data, and first, second, and third low pure color sub-pixel data (S620). For example, a PCI histogram generation block (e.g., a PCI histogram generator) 170 may divide the first, second, and third sub-pixel data into the first, second, and third high pure color sub-pixel data, and the first, second, and third low pure color sub-pixel data according to the first, second, and third PC's (S620). First, second, and third high pure color index histograms may be generated (S630), and first, second, and third low pure color index histograms may be generated (S640). For example, the PCI histogram generation block 170 may generate the first, second, and third high PCI histograms according to the gray levels of the first, second, and third high pure color sub-pixel data (S630), and may generate the first, second, and third low PCI histograms according to the gray levels of the first, second, and third low pure color sub-pixel data (S640). First, second, and third effective maximum gray levels may be determined (S650). For example, a histogram analysis block (e.g., a histogram analyzer) 180 may determine the first, second, and third effective maximum gray levels according to (e.g., based on) the first, second, and third high PCI histograms, and the first, second, and third low PCI histograms (S650).

The display device 100 for performing the method of FIG. 12 may include a controller 150*a* illustrated in FIG. 13. Compared with the controller 150 illustrated in FIG. 1, the controller 150*a* of FIG. 13 may further include a maximum gray detection block (e.g., a maximum gray detector) 155. The maximum gray detection block 155 may determine first, second, and third maximum gray levels of the first, second, and third sub-pixel data (S660). For example, the maximum gray detection block 155 may detect a maximum one of the gray levels of the first sub-pixel data included in the input image data IDAT as the first maximum gray level RMG. In addition, the maximum gray detection block 155 may determine a maximum one of the gray levels of the second sub-pixel data included in the input image data IDAT as the second maximum gray level GMG. Further, the maximum gray detection block 155 may determine a maximum one of the gray levels of the third sub-pixel data included in the input image data IDAT as the third maximum gray level BMG.

A mode may be determined to be a first mode (e.g., a first operational mode) or a second mode (e.g., a second operational mode) (S670). For example, a power supply voltage control block (e.g., a power supply voltage controller) 190*b* of the controller 150*a* may receive a mode select signal SMODE indicating the first mode or the second mode. When the mode select signal SMODE indicates the first mode (S670: MODE1), a voltage level of the power supply voltage may be determined according to (e.g., based on) the first, second, and third effective maximum gray levels (S680). For example, in this case, the power supply voltage control block 190*b* may determine the voltage level of the power supply voltage ELVDD according to (e.g., based on) the first, second, and third effective maximum gray levels REMG, GEMG, and BEMG that are determined by the histogram analysis block 180 (S680). When the mode select signal SMODE indicates the second mode (S670: MODE2), a voltage level of the power supply voltage may be determined according to (e.g., based on) the first, second, and third maximum gray levels (S690). For example, the power supply voltage control block 190*b* may determine the voltage level of the power supply voltage ELVDD according to (e.g., based on) the first, second, and third maximum gray levels RMG, GMG, and BMG that are determined by the maximum gray detection block 155 (S690). Accordingly, because the power supply voltage ELVDD is adjusted in consideration of the PCIs, power consumption of the display device 100 may be reduced while preventing or reducing a chrominance distortion.

Figure 14:
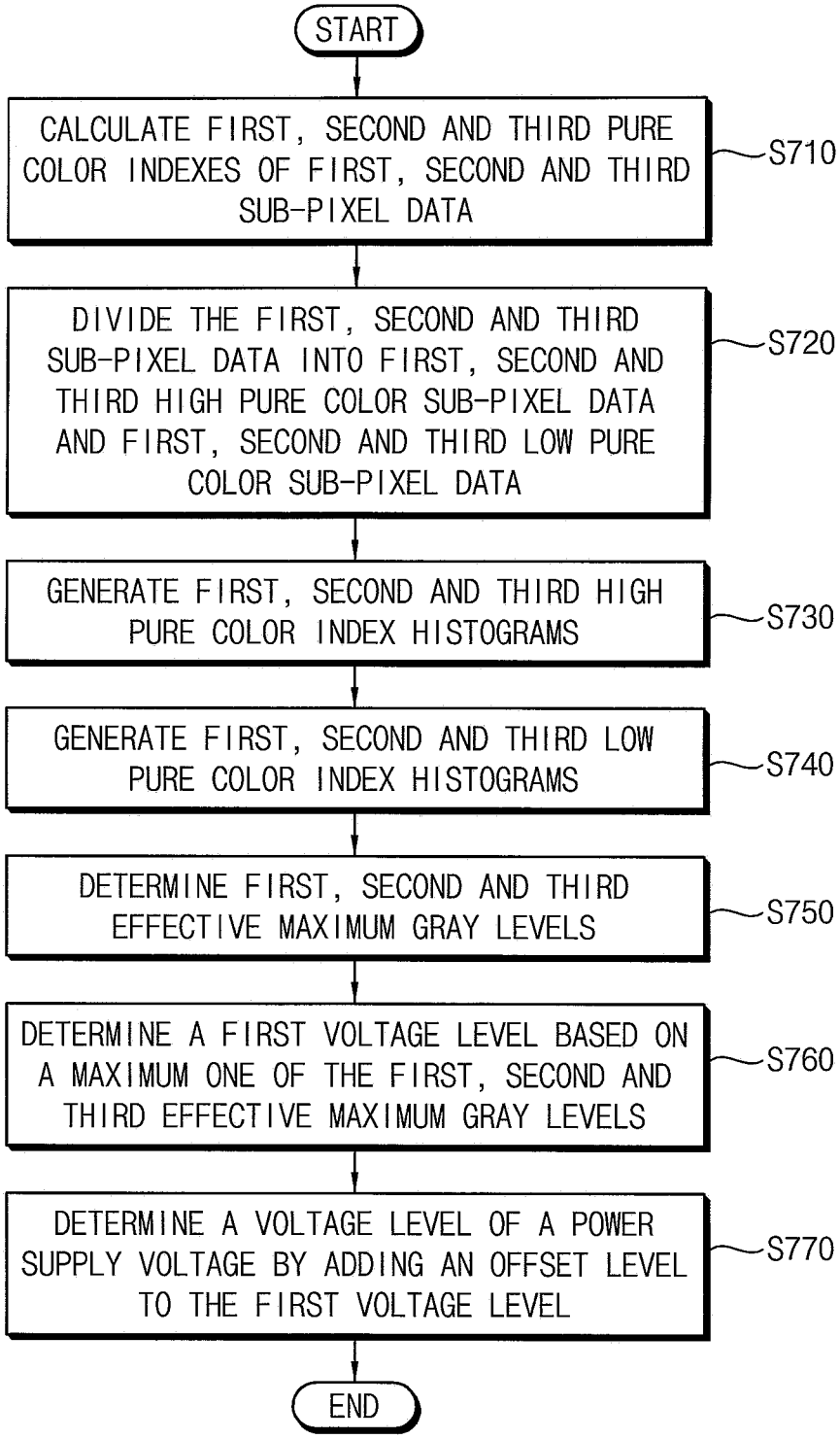
FIG. 14 is a flowchart illustrating a method of determining a power supply voltage provided to a display panel according to example embodiments.
Figure 15:
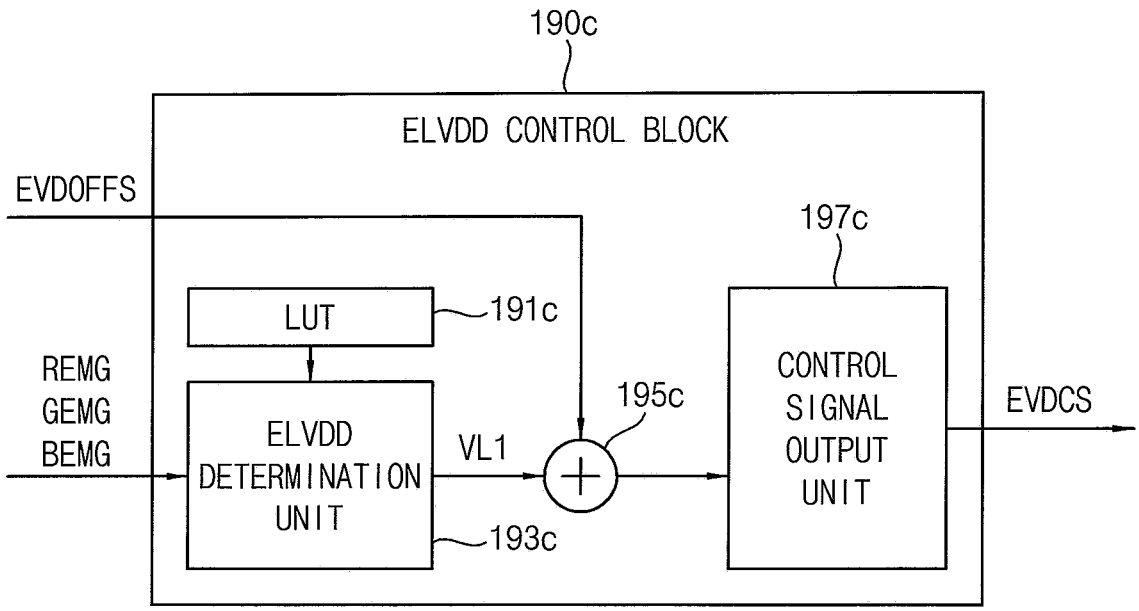
FIG. 15 is a block diagram illustrating an example of a power supply voltage control block included in a display panel that performs the method of FIG. 14.

FIG. 14 is a flowchart illustrating a method of determining a power supply voltage provided to a display panel according to example embodiments, and FIG. 15 is a block diagram illustrating an example of a power supply voltage control block included in a display panel that performs the method of FIG. 14.

The method of FIG. 14 may be the same or substantially the same as (or similar to) the method of FIG. 7, except in the method of FIG. 14, a first voltage level may be determined according to (e.g., based on) first, second, and third effective maximum gray levels (S760), and a voltage level of the power supply voltage may be determined by adding an offset level to the first voltage level (S770).

In more detail, referring to FIGS. 1 and 14, first, second, and third pure color indexes of first, second, and third sub-pixel data may be calculated (S710). For example, a PCI calculation block (e.g., a PCI calculator) 160 may calculate the first, second, and third PC's of the first, second, and third sub-pixel data for first, second, and third color sub-pixels RSP, GSP, and BSP (S710). The first, second, and third sub-pixel data may be divided into first, second, and third high pure color sub-pixel data, and first, second, and third low pure color sub-pixel data (S720). For example, a PCI histogram generation block (e.g., a PCI histogram generator) 170 may divide the first, second, and third sub-pixel data into the first, second, and third high pure color sub-pixel data, and the first, second, and third low pure color sub-pixel data according to the first, second, and third PC's (S720). First, second, and third high pure color index histograms may be generated (S730), and first, second, and third low pure color index histograms may be generated (S740). For example, the PCI histogram generation block 170 may generate the first, second, and third high PCI histograms according to the gray levels of the first, second, and third high pure color sub-pixel data (S730), and may generate the first, second, and third low PCI histograms according to the gray levels of the first, second, and third low pure color sub-pixel data (S740). First, second, and third effective maximum gray levels may be determined (S750). For example, a histogram analysis block (e.g., a histogram analyzer) 180 may determine the first, second, and third effective maximum gray levels according to (e.g., based on) the first, second, and third high PCI histograms, and the first, second, and third low PCI histograms (S750).

The display device 100 for performing the method of FIG. 14 may include a power supply voltage control block 190*c* illustrated in FIG. 15. The power supply voltage control block 190*c* may include a lookup table 191*c*, a power supply voltage determination unit (e.g., a power supply voltage determination module or a power supply voltage determination circuit) 193*c*, an adder 195*c*, and a control signal output unit (e.g., a control signal output module or a control signal output circuit) 197*c*. A first voltage level may be determined according to (e.g., based on) a maximum one of the first, second, and third effective maximum gray levels (S760). For example, the lookup table 191*c* may store the first voltage level of the power supply voltage ELVDD corresponding to each of the gray levels. In this case, the power supply voltage determination unit 193*c* may determine a maximum one from among the first, second, and third effective maximum gray levels REMG, GEMG, and BEMG as a maximum gray level, and may determine the first voltage level VL1 of the power supply voltage ELVDD corresponding to the maximum gray level by using the lookup table 191*c* (S760).

A voltage level of the power supply voltage may be determined by adding an offset level to the first voltage level (S770). For example, the adder 195*c* may receive a power supply voltage offset signal EVDOFFS indicating an offset level for the power supply voltage ELVDD, and may add the offset level to the first voltage level VL1 of the power supply voltage ELVDD (S770). In some example embodiments, the offset level may be determined according to a degree of degradation of the pixels PX of a display panel 110, but the present disclosure is not limited thereto. The control signal output unit 197*c* may provide a power supply voltage control signal EVDCS to a power supply unit (e.g., a power supply) 140. The power supply voltage control signal EVDCS may indicate the voltage level of the power supply voltage ELVDD that is output from the adder 195*c*. Accordingly, because the power supply voltage ELVDD is adjusted in consideration of the PCIs, power consumption of the display device 100 may be reduced while preventing or reducing a chrominance distortion.

Figure 16:
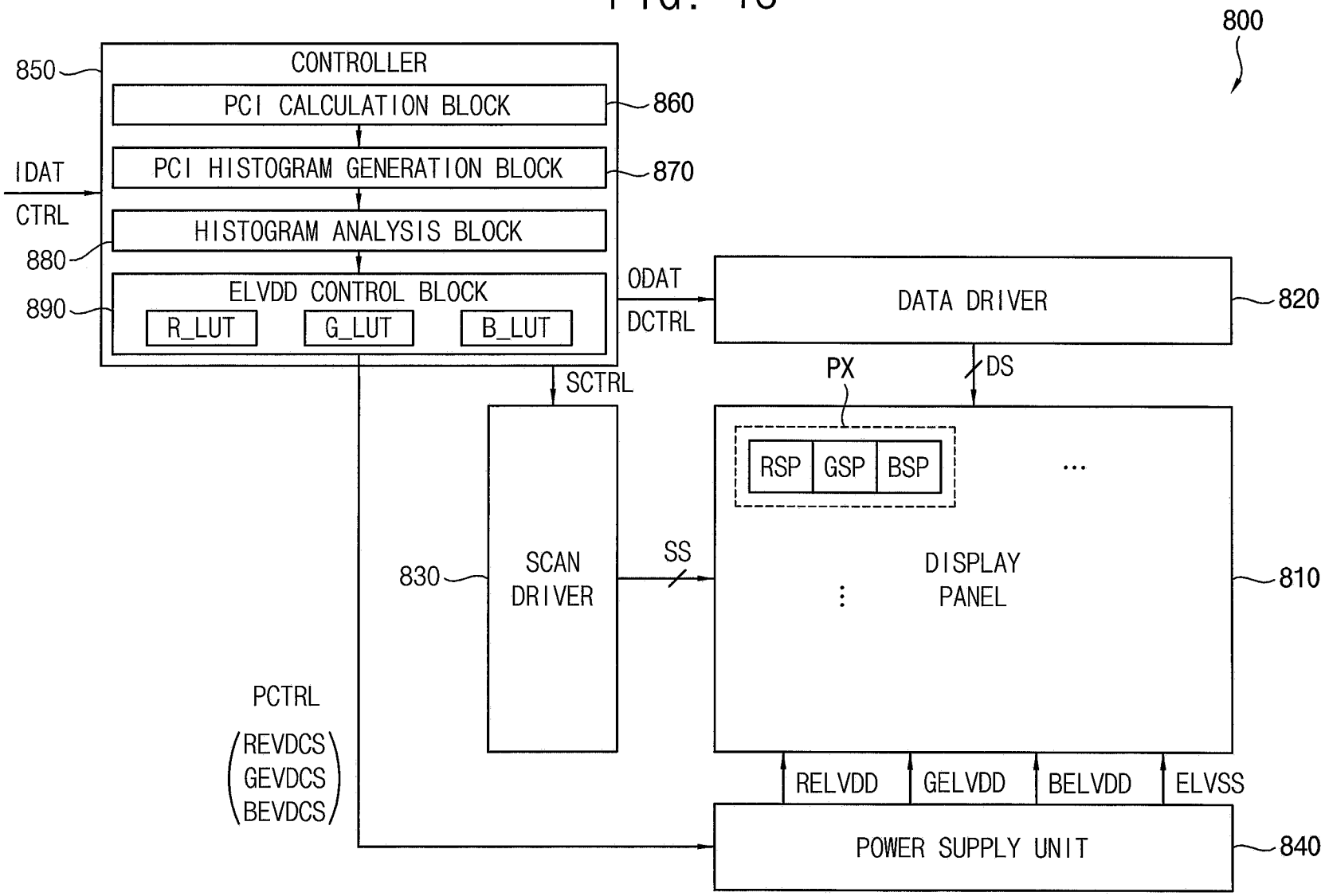
FIG. 16 is a block diagram illustrating a display device according to example embodiments.

FIG. 16 is a block diagram illustrating a display device according to example embodiments.

Referring to FIG. 16, according to example embodiments, a display device 800 may include a display panel 810, a data driver 820, a scan driver 830, a power supply unit (e.g., a power supply) 840, and a controller 850. In some example embodiments, the controller 850 may include a PCI calculation block (e.g., a PCI calculator) 860, a PCI histogram generation block (e.g., a PCI histogram generator) 870, a histogram analysis block (e.g., a histogram analyzer) 880, and a power supply voltage control block (e.g., a power supply voltage controller) 890. The display device 800 of FIG. 16 may have the same or substantially the same (or a similar) configuration and operation as those of the display device 100 of FIG. 1, except the power supply unit 840 may provide different first, second, and third power supply voltages RELVDD, GELVDD, and BELVDD to first, second, and third color sub-pixels RSP, GSP, and BSP, voltage levels of the first, second, and third power supply voltages RELVDD, GELVDD, and BELVDD may be independently determined, and the first, second, and third power supply voltages RELVDD, GELVDD, and BELVDD may be controlled according to different first, second, and third power supply voltage control signals REVDCS, GEVDCS, and BEVDCS.

The power supply unit 840 may provide, as a high power supply voltage, the first power supply voltage RELVDD for the first color sub-pixels RSP, the second power supply voltage GELVDD for the second color sub-pixels GSP, and the third power supply voltage BELVDD for the third color sub-pixels BSP to the display panel 810.

The PCI calculation block 860 may calculate first, second, and third PCIs of first, second, and third sub-pixel data for the first, second, and third color sub-pixels RSP, GSP, and BSP. The PCI histogram generation block 870 may generate first, second, and third high PCI histograms, and first, second, and third low PCI histograms according to (e.g., based on) the first, second, and third PCIs. The histogram analysis block 880 may determine first, second, and third effective maximum gray levels according to (e.g., based on) the first, second, and third high PCI histograms and the first, second, and third low PCI histograms.

The power supply voltage control block 890 may determine a voltage level of the first power supply voltage RELVDD according to (e.g., based on) the first effective maximum gray level, may determine a voltage level of the second power supply voltage GELVDD according to (e.g., based on) the second effective maximum gray level, and may determine a voltage level of the third power supply voltage BELVDD according to (e.g., based on) the third effective maximum gray level. For example, the power supply voltage control block 890 may include a first lookup table R_LUT, a second lookup table G_LUT, and a third lookup table B_LUT. The first lookup table R_LUT may store the voltage level of the first power supply voltage RELVDD corresponding to each of the gray levels for the first color sub-pixels RSP. The second lookup table G_LUT may store the voltage level of the second power supply voltage GELVDD corresponding to each of the gray levels for the second color sub-pixels GSP. The third lookup table B_LUT may store the voltage level of the third power supply voltage BELVDD corresponding to each of the gray levels for the third color sub-pixels BSP. The power supply voltage control block 890 may determine the voltage level of the first power supply voltage RELVDD corresponding to the first effective maximum gray level by using the first lookup table R_LUT, may determine the voltage level of the second power supply voltage GELVDD corresponding to the second effective maximum gray level by using the second lookup table G_LUT, and may determine the voltage level of the third power supply voltage BELVDD corresponding to the third effective maximum gray level by using the third lookup table B_LUT.

Further, the power supply voltage control block 890 may provide a first power supply voltage control signal REVDCS, a second power supply voltage control signal GEVDCS, and a third power supply voltage control signal BEVDCS to the power supply unit 840 as control signals for the high power supply voltage. For example, the first power supply voltage control signal REVDCS may indicate the determined voltage level of the first power supply voltage RELVDD, the second power supply voltage control signal GEVDCS may indicate the determined voltage level of the second power supply voltage GELVDD, and the third power supply voltage control signal BEVDCS may indicate the determined voltage level of the third power supply voltage BELVDD.

As described above, the display device 800 according to one or more example embodiments may calculate the PC's of the sub-pixel data, may generate the high PCI histograms and the low PCI histograms according to (e.g., based on) the PCIs, and may adjust the first, second, and third power supply voltages RELVDD, GELVDD, and BELVDD according to (e.g., based on) the high PCI histograms and the low PCI histograms. Accordingly, because the first, second, and third power supply voltages RELVDD, GELVDD, and BELVDD are adjusted in consideration of the PCIs, power consumption of the display device 800 may be reduced while preventing or reducing a chrominance distortion.

Figure 17:
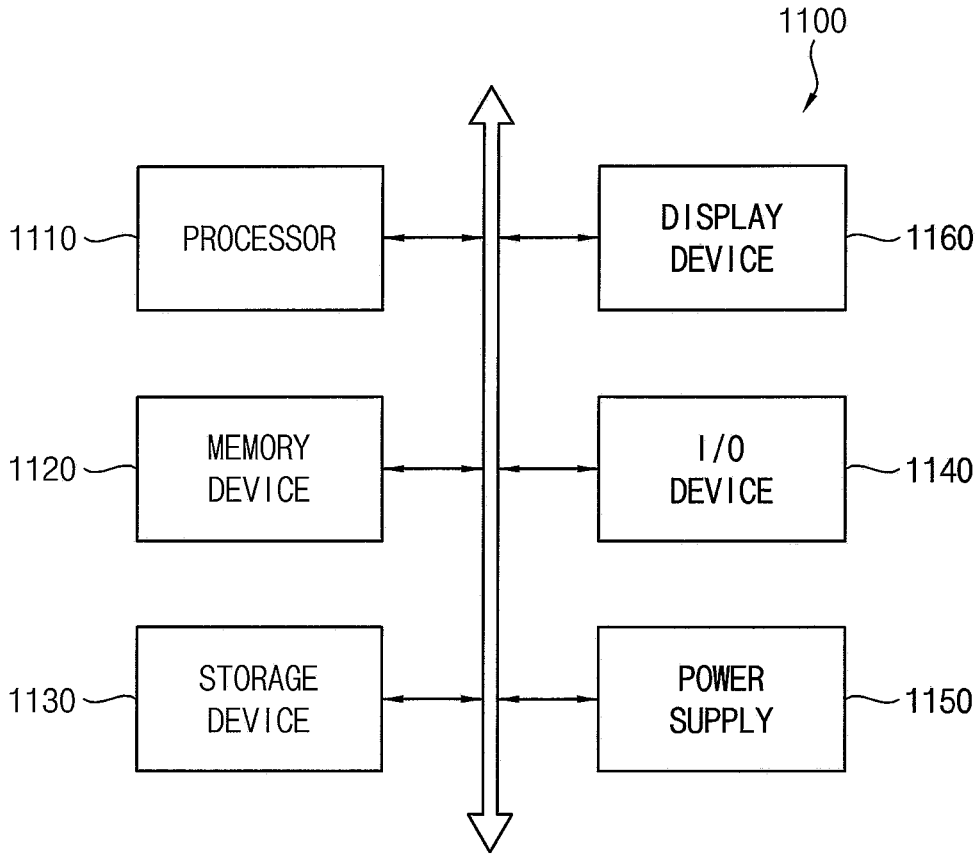
FIG. 17 is a block diagram of an electronic device including a display device according to example embodiments.

FIG. 17 is an electronic device including a display device according to example embodiments.

Referring to FIG. 17, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, and/or the like.

The processor 1110 may perform various computing functions or tasks. The processor 1110 may be an application processor (AP), a micro-processor, a central processing unit (CPU), and/or the like. The processor 1110 may be coupled to other components via an address bus, a control bus, a data bus, and/or the like. Further, in some example embodiments, the processor 1110 may be further coupled to an extended bus, for example, such as a peripheral component interconnection (PCI) bus.

The memory device 1120 may store data for operations of the electronic device 1100. For example, the memory device 1120 may include at least one non-volatile memory device, for example, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and/or the like, and/or may include at least one volatile memory device, for example, such as a dynamic random access memory (DRAM) device, a static random access memory (SRAM) device, a mobile dynamic random access memory (mobile DRAM) device, and/or the like.

The storage device 1130 may include (or may be) a solid state drive (SSD) device, a hard disk drive (HDD) device, a CD-ROM device, and/or the like. The I/O device 1140 may include (or may be) an input device, for example, such as a keyboard, a keypad, a mouse, a touch screen, and/or the like, and an output device, for example, such as a printer, a speaker, and/or the like. The power supply 1150 may supply power for operations of the electronic device 1100. The display device 1160 may be coupled to other suitable or desired components through the buses and/or other communication links.

The display device 1160 may calculate PC's of sub-pixel data, may divide the sub-pixel data into high pure color sub-pixel data and low pure color sub-pixel data according to the PCIs, may generate high PCI histograms according to (e.g., based on) the gray levels of the high pure color sub-pixel data, may generate low PCI histograms according to (e.g., based on) the gray levels of the low pure color sub-pixel data, and may adjust a power supply voltage according to (e.g., based on) the high PCI histograms and the low PCI histograms. Accordingly, because the power supply voltage is adjusted by considering the PCIs, power consumption of the display device 1160 may be reduced while preventing or reducing a chrominance distortion.

One or more aspects and features of example embodiments of the present disclosure may be applied to any suitable display device 1160, and/or to any suitable electronic device 1100 including the display device 1160. For example, the aspects and features of one or more example embodiments of the present disclosure may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, and/or the like.

The foregoing is illustrative of example embodiments and is not to be construed as limiting thereof. While various example embodiments have been described, those skilled in the art will readily appreciate that various modifications may be possible in the example embodiments without departing from the spirit and scope of the present disclosure. Therefore, it is to be understood that the foregoing is illustrative of various example embodiments, and is not to be construed as being limited to the example embodiments disclosed herein, and that all such modifications to the disclosed example embodiments, as well as other example embodiments, are intended to be included within the spirit and scope of the present disclosure as defined in the appended claims, and their equivalents.

What is claimed is:

1. A display device comprising:

a display panel comprising first color sub-pixels, second color sub-pixels, and third color sub-pixels;

a data driver configured to provide data signals to the display panel;

a scan driver configured to provide scan signals to the display panel;

a power supply configured to provide a power supply voltage to the display panel; and a controller configured to control the data driver, the scan driver, and the power supply, the controller comprising:

a pure color index calculator configured to calculate first, second, and third pure color indexes of first, second, and third sub-pixel data for the first, second, and third color sub-pixels;

a pure color index histogram generator configured to:

divide the first, second, and third sub-pixel data into first, second, and third high pure color sub-pixel data, and first, second, and third low pure color sub-pixel data according to the first, second, and third pure color indexes;

generate first, second, and third high pure color index histograms according to gray levels of the first, second, and third high pure color sub-pixel data; and generate first, second, and third low pure color index histograms according to gray levels of the first, second, and third low pure color sub-pixel data;

a histogram analyzer configured to determine first, second, and third effective maximum gray levels for the first, second, and third color sub-pixels according to the first, second, and third high pure color index histograms and the first, second, and third low pure color index histograms; and a power supply voltage controller configured to:

determine a voltage level of the power supply voltage according to the first, second, and third effective maximum gray levels; and provide a power supply voltage control signal to the power supply indicating the determined voltage level of the power supply voltage, wherein the power supply is configured to generate the power supply voltage having the determined voltage level.

2. The display device of claim 1, wherein the pure color index calculator is configured to:

calculate the first pure color index of the first sub-pixel data for each pixel by subtracting a greater one from among a gray level of the second sub-pixel data for the pixel and a gray level of the third sub-pixel data for the pixel from a gray level of the first sub-pixel data for the pixel;

calculate the second pure color index of the second sub-pixel data for each pixel by subtracting a greater one from among the gray level of the first sub-pixel data for the pixel and the gray level of the third sub-pixel data for the pixel from the gray level of the second sub-pixel data for the pixel; and calculate the third pure color index of the third sub-pixel data for each pixel by subtracting a greater one from among the gray level of the first sub-pixel data for the pixel and the gray level of the second sub-pixel data for the pixel from the gray level of the third sub-pixel data for the pixel.

3. The display device of claim 1, wherein the pure color index histogram generator is configured to:

divide the first sub-pixel data into the first high pure color sub-pixel data and the first low pure color sub-pixel data by comparing the first pure color indexes of the first sub-pixel data with a pure color index threshold value;

divide the second sub-pixel data into the second high pure color sub-pixel data and the second low pure color sub-pixel data by comparing the second pure color indexes of the second sub-pixel data with the pure color index threshold value;

divide the third sub-pixel data into the third high pure color sub-pixel data and the third low pure color sub-pixel data by comparing the third pure color indexes of the third sub-pixel data with the pure color index threshold value;

generate the first high pure color index histogram by grouping the first high pure color sub-pixel data into a plurality of gray groups according to the gray levels of the first high pure color sub-pixel data, the first high pure color index histogram indicating numbers of the first high pure color sub-pixel data belonging to the plurality of gray groups;

generate the second high pure color index histogram by grouping the second high pure color sub-pixel data into the plurality of gray groups according to the gray levels of the second high pure color sub-pixel data, the second high pure color index histogram indicating numbers of the second high pure color sub-pixel data belonging to the plurality of gray groups;

generate the third high pure color index histogram by grouping the third high pure color sub-pixel data into the plurality of gray groups according to the gray levels of the third high pure color sub-pixel data, the third high pure color index histogram indicating numbers of the third high pure color sub-pixel data belonging to the plurality of gray groups;

generate the first low pure color index histogram by grouping the first low pure color sub-pixel data into the plurality of gray groups according to the gray levels of the first low pure color sub-pixel data, the first low pure color index histogram indicating numbers of the first low pure color sub-pixel data belonging to the plurality of gray groups;

generate the second low pure color index histogram by grouping the second low pure color sub-pixel data into the plurality of gray groups according to the gray levels of the second low pure color sub-pixel data, the second low pure color index histogram indicating numbers of the second low pure color sub-pixel data belonging to the plurality of gray groups; and generate the third low pure color index histogram by grouping the third low pure color sub-pixel data into the plurality of gray groups according to the gray levels of the third low pure color sub-pixel data, the third low pure color index histogram indicating numbers of the third low pure color sub-pixel data belonging to the plurality of gray groups.

4. The display device of claim 3, wherein the pure color index threshold value is set according to a pure color index threshold parameter, and wherein boundary values between the plurality of gray groups are determined according to gray group boundary parameters.

5. The display device of claim 3, wherein the histogram analyzer is configured to:

determine a first high pure color effective maximum gray level by accumulating the numbers of the first high pure color sub-pixel data belonging to the plurality of gray groups of the first high pure color index histogram in a direction from a maximum gray group of the plurality of gray groups to a minimum gray group of the plurality of gray groups, and comparing a ratio of the accumulated numbers of the first high pure color sub-pixel data to a total number of the first high pure color sub-pixel data with a high pure color reference pixel ratio;

determine a second high pure color effective maximum gray level by accumulating the numbers of the second high pure color sub-pixel data belonging to the plurality of gray groups of the second high pure color index histogram in the direction from the maximum gray group to the minimum gray group, and comparing a ratio of the accumulated numbers of the second high pure color sub-pixel data to a total number of the second high pure color sub-pixel data with the high pure color reference pixel ratio;

determine a third high pure color effective maximum gray level by accumulating the numbers of the third high pure color sub-pixel data belonging to the plurality of gray groups of the third high pure color index histogram in the direction from the maximum gray group to the minimum gray group, and comparing a ratio of the accumulated numbers of the third high pure color sub-pixel data to a total number of the third high pure color sub-pixel data with the high pure color reference pixel ratio;

determine a first low pure color effective maximum gray level by accumulating the numbers of the first low pure color sub-pixel data belonging to the plurality of gray groups of the first low pure color index histogram in the direction from the maximum gray group to the minimum gray group, and comparing a ratio of the accumulated numbers of the first low pure color sub-pixel data to a total number of the first low pure color sub-pixel data with a low pure color reference pixel ratio;

determine a second low pure color effective maximum gray level by accumulating the numbers of the second low pure color sub-pixel data belonging to the plurality of gray groups of the second low pure color index histogram in the direction from the maximum gray group to the minimum gray group, and comparing a ratio of the accumulated numbers of the second low pure color sub-pixel data to a total number of the second low pure color sub-pixel data with the low pure color reference pixel ratio;

determine a third low pure color effective maximum gray level by accumulating the numbers of the third low pure color sub-pixel data belonging to the plurality of gray groups of the third low pure color index histogram in the direction from the maximum gray group to the minimum gray group, and comparing a ratio of the accumulated numbers of the third low pure color sub-pixel data to a total number of the third low pure color sub-pixel data with the low pure color reference pixel ratio;

determine a greater one from among the first high pure color effective maximum gray level and the first low pure color effective maximum gray level as the first effective maximum gray level;

determine a greater one from among the second high pure color effective maximum gray level and the second low pure color effective maximum gray level as the second effective maximum gray level; and determine a greater one from among the third high pure color effective maximum gray level and the third low pure color effective maximum gray level as the third effective maximum gray level.

6. The display device of claim 5, wherein the high pure color reference pixel ratio is greater than the low pure color reference pixel ratio.

7. The display device of claim 1, wherein the power supply voltage controller comprises:

a lookup table configured to store the voltage level of the power supply voltage corresponding to each of gray levels, and wherein the power supply voltage controller is configured to:

determine a maximum one from among the first, second, and third effective maximum gray levels as a maximum gray level;

determine the voltage level of the power supply voltage corresponding to the maximum gray level by using the lookup table; and provide the power supply voltage control signal to the power supply indicating the determined voltage level of the power supply voltage.

8. The display device of claim 1, wherein the display panel is divided into a plurality of pixel blocks, and wherein the pure color index histogram generator is configured to generate the first, second, and third high pure color index histograms, and the first, second, and third low pure color index histograms with respect to each of the plurality of pixel blocks.

9. The display device of claim 8, wherein the histogram analyzer is configured to:

determine a plurality of first block effective maximum gray levels, a plurality of second block effective maximum gray levels, and a plurality of third block effective maximum gray levels with respect to the plurality of pixel blocks;

determine a maximum one from among the plurality of first block effective maximum gray levels as the first effective maximum gray level;

determine a maximum one from among the plurality of second block effective maximum gray levels as the second effective maximum gray level; and determine a maximum one from among the plurality of third block effective maximum gray levels as the third effective maximum gray level.

10. The display device of claim 1, wherein the power supply voltage controller comprises:

a first lookup table configured to store a first voltage level of the power supply voltage corresponding to each of gray levels for the first color sub-pixels;

a second lookup table configured to store a second voltage level of the power supply voltage corresponding to each of gray level for the second color sub-pixels; and a third lookup table configured to store a third voltage level of the power supply voltage corresponding to each of gray levels for the third color sub-pixels, and wherein the power supply voltage controller is configured to:

determine the first voltage level of the power supply voltage corresponding to the first effective maximum gray level by using the first lookup table;

determine the second voltage level of the power supply voltage corresponding to the second effective maximum gray level by using the second lookup table;

determine the third voltage level of the power supply voltage corresponding to the third effective maximum gray level by using the third lookup table; and provide the power supply voltage control signal to the power supply indicating a maximum one from among the first, second, and third voltage levels of the power supply voltage.

11. The display device of claim 1, wherein the controller further comprises:

a maximum gray detector configured to:

determine a maximum one from among gray levels of the first sub-pixel data as a first maximum gray level;

determine a maximum one from among gray levels of the second sub-pixel data as a second maximum gray level; and determine a maximum one from among gray levels of the third sub-pixel data as a third maximum gray level, and wherein the power supply voltage controller is configured to:

receive a mode select signal indicating a first mode or a second mode;

determine the voltage level of the power supply voltage according to the first, second, and third effective maximum gray levels from the histogram analyzer when the mode select signal indicates the first mode; and determine the voltage level of the power supply voltage according to the first, second, and third maximum gray levels from the maximum gray detector when the mode select signal indicates the second mode.

12. The display device of claim 1, wherein the power supply voltage controller comprises:

a lookup table configured to store a first voltage level of the power supply voltage corresponding to each of gray levels;

a power supply voltage determination circuit configured to determine a maximum one from among the first, second, and third effective maximum gray levels as a maximum gray level, and to determine the first voltage level of the power supply voltage corresponding to the maximum gray level by using the lookup table;

an adder configured to receive a power supply voltage offset signal indicating an offset level for the power supply voltage, and to add the offset level to the first voltage level of the power supply voltage; and a control signal output circuit configured to provide the power supply voltage control signal to the power supply indicating the voltage level of the power supply voltage output from the adder.

13. The display device of claim 1, wherein the power supply is configured to provide a first power supply voltage for the first color sub-pixels, a second power supply voltage for the second color sub-pixels, and a third power supply voltage for the third color sub-pixels to the display panel as the power supply voltage, and wherein the power supply voltage controller is configured to:

determine a voltage level of the first power supply voltage according to the first effective maximum gray level;

determine a voltage level of the second power supply voltage according to the second effective maximum gray level;

determine a voltage level of the third power supply voltage according to the third effective maximum gray level; and provide a first power supply voltage control signal indicating the determined voltage level of the first power supply voltage, a second power supply voltage control signal indicating the determined voltage level of the second power supply voltage, and a third power supply voltage control signal indicating the determined voltage level of the third power supply voltage to the power supply as the power supply voltage control signal.

14. The display device of claim 13, wherein the power supply voltage controller comprises:

a first lookup table configured to store the voltage level of the first power supply voltage corresponding to each of gray levels for the first color sub-pixels;

a second lookup table configured to store the voltage level of the second power supply voltage corresponding to each of gray levels for the second color sub-pixels; and a third lookup table configured to store the voltage level of the third power supply voltage corresponding to each of gray levels for the third color sub-pixels, and wherein the power supply voltage controller is configured to:

determine the voltage level of the first power supply voltage corresponding to the first effective maximum gray level by using the first lookup table;

determine the voltage level of the second power supply voltage corresponding to the second effective maximum gray level by using the second lookup table; and determine the voltage level of the third power supply voltage corresponding to the third effective maximum gray level by using the third lookup table.

15. The display device of claim 1, wherein the first color sub-pixels are red sub-pixels, the second color sub-pixels are green sub-pixels, and the third color sub-pixels are blue sub-pixels.

16. A method of determining a power supply voltage provided to a display panel comprising first color sub-pixels, second color sub-pixels, and third color sub-pixels, the method comprising:

calculating first, second, and third pure color indexes of first, second, and third sub-pixel data for the first, second, and third color sub-pixels;

dividing the first, second, and third sub-pixel data into first, second, and third high pure color sub-pixel data and first, second, and third low pure color sub-pixel data according to the first, second, and third pure color indexes;

generating first, second, and third high pure color index histograms according to gray levels of the first, second, and third high pure color sub-pixel data;

generating first, second, and third low pure color index histograms according to gray levels of the first, second, and third low pure color sub-pixel data;

determining first, second, and third effective maximum gray levels for the first, second, and third color sub-pixels according to the first, second, and third high pure color index histograms and the first, second, and third low pure color index histograms; and determining a voltage level of the power supply voltage according to the first, second, and third effective maximum gray levels.

17. The method of claim 16, wherein the calculating of the first, second, and third pure color indexes comprises:

calculating the first pure color index of the first sub-pixel data for each pixel of the display panel by subtracting a greater one from among a gray level of the second sub-pixel data for the pixel and a gray level of the third sub-pixel data for the pixel from a gray level of the first sub-pixel data for the pixel;

calculating the second pure color index of the second sub-pixel data for each pixel by subtracting a greater one from among the gray level of the first sub-pixel data for the pixel and the gray level of the third sub-pixel data for the pixel from the gray level of the second sub-pixel data for the pixel; and calculating the third pure color index of the third sub-pixel data for each pixel by subtracting a greater one from among the gray level of the first sub-pixel data for the pixel and the gray level of the second sub-pixel data for the pixel from the gray level of the third sub-pixel data for the pixel.

18. The method of claim 16, wherein the generating of the first, second, and third high pure color index histograms comprises:

generating the first high pure color index histogram by grouping the first high pure color sub-pixel data into a plurality of gray groups according to the gray levels of the first high pure color sub-pixel data, the first high pure color index histogram indicating numbers of the first high pure color sub-pixel data belonging to the plurality of gray groups;

generating the second high pure color index histogram by grouping the second high pure color sub-pixel data into the plurality of gray groups according to the gray levels of the second high pure color sub-pixel data, the second high pure color index histogram indicating numbers of the second high pure color sub-pixel data belonging to the plurality of gray groups; and generating the third high pure color index histogram by grouping the third high pure color sub-pixel data into the plurality of gray groups according to the gray levels of the third high pure color sub-pixel data, the third high pure color index histogram indicating numbers of the third high pure color sub-pixel data belonging to the plurality of gray groups, and wherein the generating of the first, second, and third low pure color index histograms comprises:

generating the first low pure color index histogram by grouping the first low pure color sub-pixel data into the plurality of gray groups according to the gray levels of the first low pure color sub-pixel data, the first low pure color index histogram indicating numbers of the first low pure color sub-pixel data belonging to the plurality of gray groups;

generating the second low pure color index histogram by grouping the second low pure color sub-pixel data into the plurality of gray groups according to the gray levels of the second low pure color sub-pixel data, the second low pure color index histogram indicating numbers of the second low pure color sub-pixel data belonging to the plurality of gray groups; and generating the third low pure color index histogram by grouping the third low pure color sub-pixel data into the plurality of gray groups according to the gray levels of the third low pure color sub-pixel data, the third low pure color index histogram indicating numbers of the third low pure color sub-pixel data belonging to the plurality of gray groups.

19. The method of claim 18, wherein the determining of the first, second, and third effective maximum gray levels comprises:

determining a first high pure color effective maximum gray level by accumulating the numbers of the first high pure color sub-pixel data belonging to the plurality of gray groups of the first high pure color index histogram in a direction from a maximum gray group of the plurality of gray groups to a minimum gray group of the plurality of gray groups, and comparing a ratio of the accumulated numbers of the first high pure color sub-pixel data to a total number of the first high pure color sub-pixel data with a high pure color reference pixel ratio;

determining a second high pure color effective maximum gray level by accumulating the numbers of the second high pure color sub-pixel data belonging to the plurality of gray groups of the second high pure color index histogram in the direction from the maximum gray group to the minimum gray group, and comparing a ratio of the accumulated numbers of the second high pure color sub-pixel data to a total number of the second high pure color sub-pixel data with the high pure color reference pixel ratio;

determining a third high pure color effective maximum gray level by accumulating the numbers of the third high pure color sub-pixel data belonging to the plurality of gray groups of the third high pure color index histogram in the direction from the maximum gray group to the minimum gray group, and comparing a ratio of the accumulated numbers of the third high pure color sub-pixel data to a total number of the third high pure color sub-pixel data with the high pure color reference pixel ratio;

determining a first low pure color effective maximum gray level by accumulating the numbers of the first low pure color sub-pixel data belonging to the plurality of gray groups of the first low pure color index histogram in the direction from the maximum gray group to the minimum gray group, and comparing a ratio of the accumulated numbers of the first low pure color sub-pixel data to a total number of the first low pure color sub-pixel data with a low pure color reference pixel ratio;

determining a second low pure color effective maximum gray level by accumulating the numbers of the second low pure color sub-pixel data belonging to the plurality of gray groups of the second low pure color index histogram in the direction from the maximum gray group to the minimum gray group, and comparing a ratio of the accumulated numbers of the second low pure color sub-pixel data to a total number of the second low pure color sub-pixel data with the low pure color reference pixel ratio;

determining a third low pure color effective maximum gray level by accumulating the numbers of the third low pure color sub-pixel data belonging to the plurality of gray groups of the third low pure color index histogram in the direction from the maximum gray group to the minimum gray group, and comparing a ratio of the accumulated numbers of the third low pure color sub-pixel data to a total number of the third low pure color sub-pixel data with the low pure color reference pixel ratio;

determining a greater one from among the first high pure color effective maximum gray level and the first low pure color effective maximum gray level as the first effective maximum gray level;

determining a greater one from among the second high pure color effective maximum gray level and the second low pure color effective maximum gray level as the second effective maximum gray level; and determining a greater one from among the third high pure color effective maximum gray level and the third low pure color effective maximum gray level as the third effective maximum gray level.

20. The method of claim 19, wherein the high pure color reference pixel ratio is greater than the low pure color reference pixel ratio.

* * * * *